US012643189B2

(12) United States Patent
Tulodziecki et al.

(10) Patent No.: US 12,643,189 B2
(45) Date of Patent: Jun. 2, 2026

(54) MOBILE MACHINE TOOL FOR MACHINING A SURFACE

(71) Applicant: Festool GmbH, Wendlingen (DE)

(72) Inventors: Stefan Tulodziecki, Neuhausen (DE); Mutasem Rabah, Wendlingen (DE)

(73) Assignee: Festool GmbH, Wendlingen (DE)

( * ) Notice: Subject to any disclaimer, the term of this patent is extended or adjusted under 35 U.S.C. 154(b) by 1094 days.

(21) Appl. No.: 17/055,376

(22) PCT Filed: May 15, 2019

(86) PCT No.: PCT/EP2019/062541
§ 371 (c)(1),
(2) Date: Nov. 13, 2020

(87) PCT Pub. No.: WO2019/219779
PCT Pub. Date: Nov. 21, 2019

(65) Prior Publication Data

US 2021/0213584 A1 Jul. 15, 2021

(30) Foreign Application Priority Data

May 16, 2018 (DE) ..... 10 2018 111 836

(51) Int. Cl.
*B24B 23/02* (2006.01)
*B24B 7/00* (2006.01)

(52) U.S. Cl.
CPC ..... *B24B 23/02* (2013.01); *B24B 7/00* (2013.01)

(58) Field of Classification Search
CPC ..... B24B 23/02; B24B 7/00; B24B 55/06; B24B 55/10; B24B 55/102; B24B 55/105;
(Continued)

(56) References Cited

U.S. PATENT DOCUMENTS 4,058,936 A * 11/1977 Marton ..... B24B 55/102 451/359
4,399,638 A * 8/1983 Rodowsky, Jr. ..... F01D 15/062 15/387

(Continued)

FOREIGN PATENT DOCUMENTS

CN 1676283 A 10/2005
CN 101143438 A 3/2008

(Continued)

*Primary Examiner* — Brian D Keller
*Assistant Examiner* — Jason Khalil Hawkins
(74) *Attorney, Agent, or Firm* — Hoffmann & Barron, LLP

(57) ABSTRACT

A mobile machine tool for processing a surface of a workpiece or a room, wherein the machine tool includes a working device with a plate tool for processing the surface and a drive motor for driving the plate tool, which tool has a processing surface assigned to processing a workpiece and a machine side opposite to the processing surface, wherein intake air inflow openings are arranged on the surface to be processed for suctioning the processing surface onto the surface to be processed, which openings are flow-connected to at least one intake air outflow opening arranged on the plate tool away from the processing surface, wherein the plate tool includes at least one additional air inflow opening for the inflow of additional air, which is flow-connected to at least one additional air outflow opening arranged away from the processing surface, and wherein the machine tool includes an intake device for generating an intake air flow and/or a negative pressure at the at least one intake air outflow opening and the at least one additional air outflow opening.

17 Claims, 13 Drawing Sheets

Figure 1:
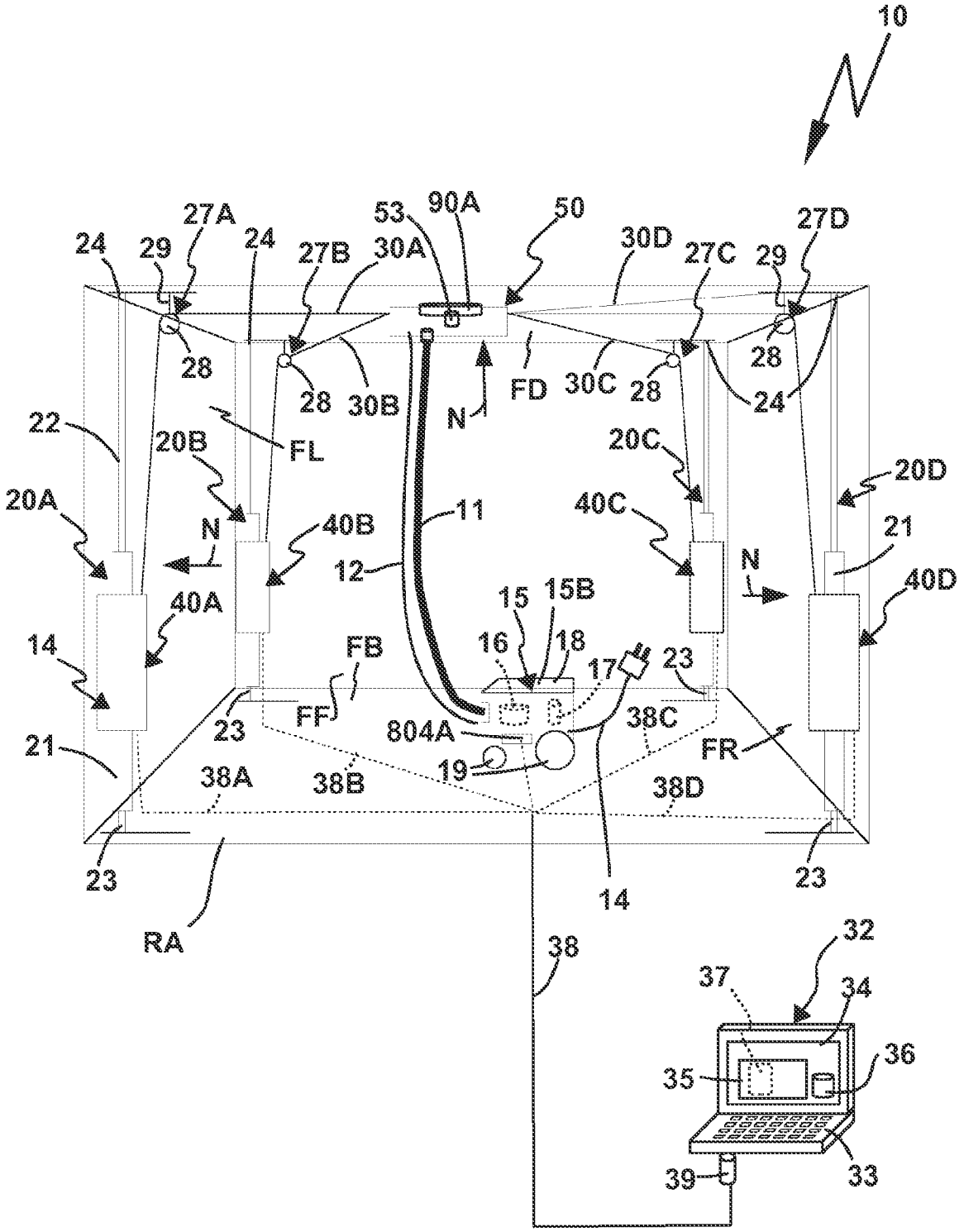

(58) Field of Classification Search
CPC ..... B24B 7/18; B24B 7/182; B24B 7/184; B24B 7/186
USPC ..... 451/259
See application file for complete search history.

(56) References Cited

U.S. PATENT DOCUMENTS 4,905,421 A * 3/1990 Maier ..... B24B 23/02 451/359
5,218,790 A * 6/1993 Huang ..... B24B 23/026 451/359
5,545,080 A * 8/1996 Clowers ..... B24B 7/184 451/354
5,582,541 A * 12/1996 Hutchins ..... B24B 23/03 451/344
5,964,645 A * 10/1999 Jemt ..... B24B 7/241 451/388
5,993,305 A * 11/1999 Chu ..... B24B 23/03 451/357
6,004,197 A * 12/1999 Huber ..... B24B 23/026 451/357
6,190,245 B1 * 2/2001 Heidelberger ..... B24B 55/105 451/357
6,257,970 B1 * 7/2001 Huber ..... B24B 23/03 451/344
7,040,972 B2 * 5/2006 Hoffmann ..... B24B 47/14 451/442

FOREIGN PATENT DOCUMENTS

| | | | |
|---|---|---|---|
| CN | 106425871 | A | 2/2017 |
| DE | 4023464 | A1 | 1/1992 |
| DE | 102016100072 | A1 | 7/2017 |
| DE | 102016114099 | A1 | 2/2018 |
| EP | 3002081 | A2 | 4/2016 |
| EP | 3187305 | A2 | 7/2017 |
| JP | H07237131 | A | 9/1995 |
| WO | 2005/025398 | A1 | 3/2005 |

* cited by examiner

MOBILE MACHINE TOOL FOR MACHINING A SURFACE

This application claims priority based on an International Application filed under the Patent Cooperation Treaty, PCT/EP2019/062541, filed May 15, 2019, which claims priority to DE 102018111836.8, filed May 16, 2018.

BACKGROUND OF THE INVENTION

The invention relates to a mobile machine tool for processing a surface of a work-piece or of a room, wherein the machine tool comprises a working device having a plate tool for processing the surface and a drive motor for driving the plate tool, which tool comprises a processing surface associated with processing a workpiece and a machine side opposite to the processing surface, wherein intake air inflow openings are arranged on the surface to be processed for suctioning the processing surface onto the surface to be processed, which openings are flow-connected to at least one intake air outflow opening arranged on the plate tool away from the processing surface, wherein the plate tool comprises at least one additional air inflow opening for the inflow of additional air, which is flow-connected to at least one additional air outflow opening arranged away from the processing surface, and wherein the machine tool comprises an intake device for generating an intake air flow and/or a negative pressure at the at least one intake air outflow opening and the at least one additional air outflow opening.

Such a machine tool is described, for example, in DE 10 2016 100 072 A1. The additional air inflow openings are arranged on an edge region of the plate tool, so that they suction additional air from the environment of the plate tool. The grinding plate is actually suctioned onto the workpiece surface via the intake air inflow openings provided on the processing surface. The air flowing in there is dust-laden and at the same time creates a negative pressure in the region of the processing surface, such that this surface is suctioned onto the workpiece surface or the room surface to be machined.

For example, the suction power of a vacuum cleaner that is connected to a suction port of the mobile machine tool can be used to set the suction power and thus the suction force with which the machine tool or its working device is suctioned onto the surface of the room or workpiece. Furthermore, manually operated valves or the like can be provided.

It is therefore the object of the present invention to provide an improved suction concept in a machine tool of the type mentioned at the outset.

To achieve the object, the intake device of a machine tool of the type mentioned at the outset has a suction controller for controlling the intake air flow and/or the negative pressure in the region of the at least one additional air outflow opening.

A basic idea here is that, as it were, the intake air flow or the negative pressure or both can be set in the region of the additional air outflow opening, such that, for example, the at least one additional air inflow opening can be activated as an additional inflow opening that draws the machine tool to the surface and/or in order to change an overall suction power of the suction device between the at least one additional air inflow opening and the suction air inflow openings, such that there is a greater suction power of the suction device in the region of the suction air inflow openings arranged on the processing surface, for example.

A grinding means for processing a workpiece or a holding means for detachably holding such a grinding means is preferably arranged on the processing surface. It is possible that both are provided, namely that there is a holding means on which a grinding means is held.

The grinding means and/or the holding means expediently comprise throughflow openings corresponding to the intake air inflow openings, such that air can be suctioned in through the passage openings into the intake air inflow openings from the front or processing side of the grinding means or the holding means. The holding means for detachably holding the grinding means expediently comprises a Velcro arrangement, for example Velcro hooks, a Velcro felt or the like.

Preferably a receiving holder, for example a projection, a retaining pin, a bayonet contour or the like is located on the machine side of the plate tool for attachment to a tool receiving device of the working device. It is therefore advantageous if the plate tool is detachably arranged on the working device. For example, if the holding means or the grinding means are worn, the plate tool can be replaced.

The tool holder or the plate tool is directly connected to the drive motor, for example in the manner of a direct drive, or motion-coupled, for example by means of a transmission and/or an eccentric bearing or the like.

The suction controller is expediently designed for controlling the intake air flow and/or the negative pressure in the region of the at least one intake air outflow opening. It is therefore possible for the negative pressure or intake air flow to be directly adjustable in the region of the intake air inflow openings. For example, a valve which can adjust the negative pressure or intake air flow in the region of the intake air outflow opening is provided.

However, it is also possible that the intake air flow and/or the negative pressure in the region of the at least one intake air outflow opening cannot be influenced by the suction controller or can only be influenced by controlling the intake air flow or the negative pressure in the region of the at least one additional air outflow opening. The suction power which is basically available is thus set indirectly, so to speak, by setting the negative pressure or the intake air flow in the region of the at least one additional air inflow opening.

It is possible that a substantially constant or constant intake air flow or a substantially constant or constant negative pressure is be available in the region of the at least one intake air outflow opening. However, it is also possible to change the flow conditions and/or pressure conditions in the region of the intake air inflow openings, which preferably perform a priority intake or main intake of the plate tool and thus of the machine tool, by changing the intake air flow or the negative pressure in the region of the at least one additional air outflow opening and thus also changing the flow conditions and/or pressure conditions in the region of the intake air inflow opening(s).

The suction device comprises, for example, a vacuum generator for generating a negative pressure and/or an intake air flow, which generator is arranged on the working device, for example on the housing thereof. It is also possible that, in addition to, or as a replacement for, the vacuum generator already mentioned, the suction device has a suction port arranged on the working device for a vacuum generator that is separate from the working device or machine tool, in particular spatially distant. This vacuum generator is formed, for example, by a vacuum cleaner. A flexible flow line, for example a suction hose, can be connected to the suction port. For example, the suction port can be provided for connecting a suction hose of the vacuum cleaner or vacuum generator. The suction port is preferably a connecting piece or a sleeve.

The suction controller preferably has at least one valve for controlling the intake air flow and/or the negative pressure in the region of the at least one intake air outflow opening and/or in the region of the at least one additional air outflow opening, wherein a valve inlet of the valve of the at least one intake air outflow opening and/or the at least one additional air outflow opening is connected and a valve outlet of the valve is or can be connected to a vacuum generator. The pressure conditions can therefore be adjusted without changing the suction power of the vacuum generator based on the valve and/or flow conditions in the region of the at least one intake air outflow opening or the at least one additional air outflow opening.

The valve is arranged, for example, in a flow channel between the at least one intake air outflow opening or the additional air outflow opening or both and the vacuum generator or the suction port for the vacuum generator and thus connected between the respective outflow openings and the vacuum generator. The valve member of the valve member is adjustable between, for example, a blocking position that closes the flow channel and a passage position that opens the flow passage, and preferably at least one intermediate position between the blocking position and the passage position.

The valve includes, for example, a control valve, a switching valve or the like. The valve can be switchable between a passage position for allowing and a blocking position for blocking a flow connection between the vacuum generator and outflow openings of the plate tool. However, the valve can also switch intermediate positions between such a passage position and blocking position, or it can also not be fully closable and/or fully openable. For example, the valve can be or comprise a proportional valve.

Preferably, the valve member is rotatable and/or movable and/or pivotably mounted between the at least two valve positions with respect to a valve housing of the valve. An axis of rotation or pivot axis of the valve member can for example run parallel to the main flow axis of the valve, but also at a slight inclination thereto, for example a maximum of 10° or 15°. It is also possible that the axis of rotation or pivot axis of the valve member runs transversely to the main flow axis of the valve, for example, transversely at right angles. A superimposed pivoting-sliding movement of the valve member is easily possible.

The valve member comprises, for example, a cylinder body, on the outer peripheral wall of which at least one recess is arranged. A plurality of recesses can be provided on the peripheral wall, for example at longitudinal intervals and/or Angular distances.

To change the flow cross-section of the valve, the peripheral wall and thus the at least one recess on the peripheral wall can be adjusted with respect to a valve housing.

Preferably, the valve has a motorized valve drive and/or a spring assembly and/or has a manually operable operating handle for moving the valve member. It goes without saying that combinations are possible, that is, for example, that a manually operable valve member is additionally spring-loaded. A valve that is actually driven by a motor or by a spring arrangement can easily be operated manually as well.

It is advantageous if the valve member is operated or can be operated as a function of an angular position of the working device relative to an underlying surface. For example, the valve member can be movably mounted in a valve housing of the valve and operated by gravity in such a manner that it changes the flow cross-section of the valve, for example opens or closes, reduces or enlarges it, depending on an angular position of the working device. The valve member can, for example, open a passage of the valve when processing a ceiling surface, and partially or fully close the passage of the valve when processing a side wall of a room. When a floor region is to be worked, the valve can completely close the passage.

A fixing device, for example a latching device, and/or a clamping device and/or at least one magnet, is advantageously provided for fixing the valve member in place in at least one valve position.

The latching device can for example comprise latching contours on the valve member, in particular, its manual operating handle, and a component that is stationary with respect to the valve housing of the valve. When the operator operates the operating handle, the locking contours can then lock into one another at predetermined positions.

A clamping device can, for example, comprise, or be formed by, a spring arrangement or a clamping disk, such that, for example, the valve member is correspondingly stiff.

A magnet holder can, for example, provide a magnet on the valve member which implements a magnetic hold with another magnetic element, for example a magnet or a ferromagnetic component that is stationary with respect to the valve housing.

It is preferred if the valve member can be locked or fixed in predetermined valve positions in which, for example, specific flow conditions or negative pressure distributions between the intake air inflow openings on the one hand and the additional air inflow openings on the other hand can be set. For example, a predetermined position of the valve member can be provided for wall processing by the machine tool, while another position is provided for ceiling processing or floor processing. For ceiling processing, for example, the valve member is in such a valve position that the flow cross-section of the valve is larger than for wall processing.

Thus, for example, more intake air or negative pressure can be present in the region of the intake air inflow openings. But is also possible that the valve member releases a larger flow cross-section when working on the ceiling, namely when additional air is to flow through additional air inflow openings that are not arranged in terms of suctioning the plate tool to the surface, for example inflow openings arranged on the outer circumference of the plate tool, such that the suction power in the region of the intake air inflow openings is correspondingly lower.

In a preferred embodiment of the invention, the valve member is spring-loaded in the direction of a closed position that closes the valve and can be operated by negative pressure in the direction of its open position. Thus, for example, a negative pressure in the region of the at least one additional air outflow opening can be able to open the valve member in the direction of its open position against the force of a spring arrangement spring-loading the valve member into the closed position. But it is also possible that a negative pressure away from the outflow side opens the valve member, such that a respective negative pressure can be generated in the region of the intake air outflow openings or the additional air outflow openings, for example.

In an embodiment of the invention, at least one bypass channel connected to the at least one suction air outflow opening is provided leading past the at least one valve. But it is also possible that suction air from the at least one suction air outflow opening always leads through the bypass duct or an arrangement of several bypass ducts past the valve or valves in the direction of the vacuum generator or a suction port for the vacuum generator, that is to say, that the valve only influences the flow conditions or pressure conditions in the region of the at least one additional air intake opening.

The additional air inflow openings can be provided in different regions of the plate tool.

In one embodiment, for example, the at least one additional air inflow opening comprises, or is formed by, an additional air inflow opening arranged on the processing surface. Of course, multiple additional air inflow openings can be arranged on the processing surface. Using the additional air inflow opening on the processing surface, it is possible to directly influence the suction force of the plate tool onto the surface to be processed.

It is preferred if the at least one additional air inflow opening or all additional air inflow openings are arranged on a radial outer circumference of the plate tool. The intake air inflow openings are therefore preferably arranged in a central region of the plate tool, while the additional air inflow opening or inflow openings are arranged at the edge region of the plate tool.

At this point it should also be mentioned that the plate tool preferably has a circular circumference or an oval circumference. In particular, the plate tool is provided for rotary actuation by the drive motor. However, it is also possible that the plate tool has a triangular, rectangular, or square contour, for example. For example, the plate tool can be provided for an embodiment of the working device as an orbital sander or oscillation sander or an oscillating grinding treatment of the surface. However, preferred is an embodiment of the working device as a rotary grinding machine and/or an eccentric grinding machine.

It is preferred if the at least one additional air inflow opening comprises, or is formed by, an additional air inflow opening arranged on an outer circumference of the plate tool, in particular, on an outer edge region of the plate tool, between the machine side and the processing surface. Thus, dust and other particles from the area around the plate tool can be suctioned in via the additional air inflow opening on the outer edge region, in particular on the outer peripheral region, of the plate tool. This facilitates dust-free or low-dust working.

It is preferred if the plate tool has an annular arrangement of inflow openings about an axis of rotation or about a central axis of the plate tool that is orthogonal to the processing surface. The at least one additional air inflow opening and/or the intake air inflow openings form part of the arrangements of such inflow openings. It goes without saying that multiple, in particular concentric, ring arrangements of inflow openings, that is to say, additional air inflow openings or intake air inflow openings, can be provided.

The inflow openings of the respective arrangement of inflow openings are expediently arranged at equal angular distances from one another. A ring arrangement of inflow openings has inflow openings at equal angular distances, for example.

Furthermore, the arrangements of additional air inflow openings and intake air inflow openings are arranged concentrically with respect to the axis of rotation or central axis of the plate tool in a preferred embodiment.

The outflow openings are expediently located on the machine side of the plate tool. For example, the at least one intake air outflow opening and/or the at least one additional air outflow opening are arranged there.

It is preferred if one or more additional air inflow openings are assigned to an additional air outflow opening. It is likewise advantageous with respect to a respective intake air outflow opening if one or more intake air inflow openings are assigned to it.

It is also preferred that multiple intake air outflow openings and/or multiple additional air outflow openings are present. In particular, these are designed or arranged in ring arrangements. For example, it is advantageous if the plate tool has an annular arrangement of outflow openings about an axis of rotation or about a central axis of the plate tool that is orthogonal to the processing surface, wherein the at least one intake air outflow opening and/or the at least one additional air outflow opening forms part of such an arrangement of inflow openings.

In the case of the ring arrangements of outflow openings, it is likewise advantageous if they have outflow openings arranged at equal angular distances from one another. Furthermore, it is also advantageous with these arrangements if the arrangement of additional air outflow openings and the arrangement of intake air outflow openings are concentric with respect to the axis of rotation or the central axis of the plate tool. For example, the intake air outflow openings can be radially on the inside with respect to the axis of rotation or central axis, and the additional air outflow openings can be radially outside.

The intake device preferably has separate inlets for the additional air outflow opening and the intake air outflow opening or the respective arrangement thereof. For example, the intake device has one intake air inlet assigned to the at least one intake air outflow opening and one additional air inlet assigned to the at least one additional air outflow opening.

The intake air inlet or the auxiliary air inlet or both can have an annular or partially annular geometry. It is possible that one of the inlets is designed as a chamber or inlet chamber, around which the respective other inlet extends in an annular or partially annular manner.

The intake air inlet and the additional air inlet expediently run in a ring about an axis of rotation of the plate tool or a central axis of the plate tool. The additional air inlet and the intake air inlet are preferably concentric with respect to the axis of rotation or central axis.

The intake air inlet and the additional air inlet can be at least partially flow-connected. It is possible, for example that false air, so to speak, flows from one inlet to the other inlet. This can be acceptable if the suction power of the suction device or the vacuum generator is sufficient.

It is preferred, however, if the intake air inlet and the additional air inlet are flow-separated from one another by at least one seal, for example an annular seal. The at least one seal expediently runs in a ring around the axis of rotation or central axis of the plate tool. The at least one seal is preferably in the sealing seat or sealingly on the machine side of the plate tool. Seals that are concentric to one another are preferred, such that, for example, an annular additional air inlet or intake air inlet is defined by the seals.

The at least one seal can be a rubber seal or an elastic seal, for example. The at least one seal can, for example, also be a brush seal.

According to a preferred concept, the at least one seal with comprises a radially outer seal and a radially inner seal respect to an axis of rotation or central axis of the plate tool, which seals are provided and/or designed to rest against the machine side of the plate tool. The two seals define an annular chamber running about the axis of rotation or the central axis of the plate tool and a central chamber which is enclosed by the annular chamber and is fluidically separated from the annular chamber by the radially inner seal. It is possible in this case that the annular chamber forms the additional inlet and the central chamber forms the intake air inlet. But it is also possible for the annular chamber to form, or be assigned to, the intake air inlet and for the central chamber to form, or be assigned to, the additional air inlet.

The machine tool is preferably a working device that can be operated or grasped manually. In one embodiment of the invention, a particularly rod-shaped handle can be arranged on the working device for gripping by an operator. The handle is preferably mounted on the working device so as to be pivotable or rotatable about at least one pivot axis, preferably about at least two pivot axes which are at an angle to one another. For example, a gimbal bearing or a ball bearing can be provided between the handle and the working device.

According to another concept, the machine tool has a positioning device with at least one positioning drive for positioning the working device transversely to the normal direction of the surface. For example, an electric drive with which the working device performs a movement along the surface can be provided on the working device. For example, a drive roller or a drive wheel can be provided on the working device. Furthermore, it is advantageous if the working device comprises at least one holding device which can be fastened in place relative to the surface and which is connected to the working device by means of at least one flexurally flexible traction member. The traction member can for example be a rope, a toothed belt or the like. The working device can preferably be positioned using the traction member. But it is also possible that the traction member only serves to prevent the working device from falling to the ground in an uncontrolled manner. Furthermore, the traction member can also be used to support the operator in the as such manual operation of the working device.

It is preferred if an energizing device for energizing the working device is arranged on the handle. For example, the drive motor for the work tool can be energized using the energizing device.

The handle is expediently telescoping. The handle preferably has a base tubular body which engages in an adjustable tubular body or into which an adjustable tubular body engages. The adjustable tubular body is therefore received in the base tubular body or vice versa. It is also advantageous if the two tubular bodies can be clamped using a clamping device, in particular a clamp, in at least two mutually different longitudinal positions that the tubular bodies can have relative to one another. The clamp can comprise, for example, a clamping screw, a clamping lever or the like.

It is possible that the section between the energizing device and the working device has a predetermined length and/or is not telescoping. The telescoping section of the handle expediently has a support body for support on a body of the operator. A longitudinal position of the support body with respect to the energizing device can be set using the telescoping handle. A longitudinal extension of the support body expediently runs transversely to the longitudinal extension of the handle or the telescoping section of the handle.

The machine tool preferably forms a mobile working device of a surface processing system for coating and/or abrasive processing of a surface of a workpiece or a room. The working device is mobile relative to the surface.

Advantageously, the surface processing system has at least one holding device which can be fastened in place relative to the surface and which is connected to the working device by means of at least one flexurally flexible traction member.

The flexurally flexible traction member can, for example, be a rope, a toothed belt or the like. The flexurally flexible traction member is suitable, for example, for positioning and/or supporting the working device relative to the surface to be processed. For example, the flexurally flexible traction member can prevent the working device from falling onto an underlying surface, or at least brake it.

The work tool is preferably a plate tool and/or a grinding tool. For example, a sanding belt, sanding disc or the like can be provided as the work tool.

The drive motor with which the tool holder is or can be driven is preferably provided or designed for rotationally driving the tool holder about an axis of rotation and/or for eccentrically rotationally driving the tool holder. It is possible that the working device can be switched between an eccentric mode, in which the tool holder and thus the work tool undergo eccentric movements, and a pure rotary mode, in which the work tool just rotates about an axis of rotation but has no eccentricity.

The coating tool can, for example, be a spray device for spraying on paint. But the coating tool can, for example, also comprise a roller or similar other application bodies for applying paint or similar other coatings to the surface of the workpiece or the room.

Instead of, or in addition to, the tool holder or the coating device driven by the drive motor, the working device can also comprise a cleaning device. The working device can therefore form a cleaning device, so to speak. The cleaning device can, for example, be a brush arrangement for brushing the surface and/or one or more nozzles for dispensing a cleaning liquid or the like. The cleaning device can, for example, be a high-pressure cleaning device.

The holding device, which can be fastened in place relative to the surface, is connected to the working device by means of one or more flexurally flexible tension members, which can be used, for example, to prevent the working device from falling to the ground or to hold it on the wall or other surface. The traction member can, so to speak, support the suction device.

The traction member can, for example, provide weight compensation for the working device. For example, the working device can be suspended, so to speak, on the traction member. For example, the traction member is spring-loaded by a spring arrangement, such that the spring arrangement fully or partially compensates for the weight of the working device. The spring arrangement can act directly on the traction member and/or apply a load to a winding body, that is, winding the tension member onto the winding body.

Preferably, the surface processing system has a positioning device with at least one positioning drive for positioning the working device transversely to the normal direction of the surface.

Preferably, multiple positioning drives are provided for multiple degrees of freedom of movement and/or directions of movement.

The at least one positioning drive can, for example, assist the operator, who otherwise operates the working device manually. It is a basic idea that the operator, with the assistance of the at least one positioning drive, positions the working device transversely to the normal direction, in particular multi-axially or bi-axially transversely to the normal direction.

At least one positioning drive is advantageously arranged on board the working device. For example, the positioning drive includes a drive roller driven by a drive motor for rolling on the surface of the workpiece or room to be processed.

Autonomous processing of the surface, for example, coating or abrasive processing of the surface, is easily possible using the at least one positioning drive. The surface processing system works independently, so it does not need any direct specifications.

A preferred embodiment of the invention provides that one or more of the positioning drives are arranged on the holding device and actuate the traction member. The holding device therefore has the or a positioning drive for the at least one traction member. This positioning drive of the holding device can be provided in addition to, or instead of, a positioning drive on board the working device. It is also advantageous if the surface processing system has at least two or at least three, more preferably even at least four traction members. In the case of the holding devices, too, it is advantageous if two, at least three or even four holding devices are provided. The holding devices can be arranged, for example, in corner regions of the surface to be processed, such that the working device can be maneuvered between the holding devices. One traction member is assigned to each holding device. But it is also possible that several traction members are held on a holding device. In this way, a higher tensile force can be achieved, for example. With several holding devices, for example three or four holding devices and respective tension members, which extend between the holding device and the working device, the working device can be easily maneuvered on the surface of the workpiece or room to be processed.

It is preferred that a plurality of traction member holders for holding at least one traction member are present on the holding device, wherein the traction member holders are preferably assigned to different directions of force in which the traction members act on the working device. It is preferred, for example, that the traction member holders are arranged at the same angular distances. The traction member holders can be provided or designed for a fixed, non-detachable or detachable connection between the traction member and the working device.

In the case of the traction member holders, it is advantageous if they allow locking connections and/or magnetic connections and/or clamp connections and/or hook connections or the like with the respective traction member. For example, latch receptacles and/or latching projections and/or magnetic holders and/or bayonet contours or the like can be provided on a respective traction member holder, which can be brought into a fixed, preferably detachable connection with respective complementary connecting means at the respective longitudinal end of a traction member. Of course, it is advantageous if the traction member holders allow mobility, for example pivotability, of a respective traction member relative to the working device. For example, pivot bearings can be provided on the traction member holders. But it is also possible, that eyelets or the like, for example, have other receiving contours which allow the respective traction member to move freely in relation to the working device.

The at least one positioning drive expediently comprises at least one traction member drive for driving the traction member. The traction member drive can for example be arranged on board the working device, on the holding device or the like. It is possible that a traction member drive is present both on the holding device and on the working device. The traction member drives preferably work together.

The at least one positioning drive can comprise or be formed by at least one working device drive arranged on board the working device. In the case of the latter configuration, a traction member drive can for example be supported by the work device drive. But the traction member drive and the working device drive can also be assigned to different directions of movement, for example, directions of movement that are at an angle to one another, in particular right-angled directions of movement. For example, the traction member drive can be provided for a forward or backward movement of the working device along the surface to be processed, while the working device drive is provided and/or designed for positioning movements transversely thereto.

In principle, it is possible that a tension member that is not active in relation to its direction of force sags, for example. A tension member can also be spring-loaded by a spring arrangement, such that it is held under tension between the holding device on the one hand and the working device on the other.

However, it is preferred that a winding device for winding up the tension member is present. The winding device is preferably motor-driven or spring-loaded. In principle, however, the winding device can also be actuated manually, for example, it can have a crank or similar other operating handle.

It is also advantageous if a positioning drive or the positioning drive which respectively operates a traction member, is arranged between the working device and the at least one winding device. If, for example, the traction member comprises a toothed belt or toothed belt section, the positioning drive can exactly influence a respective longitudinal position of the traction member.

Alternatively, it is easily possible to provide the positioning drive on the winding device or to design it as a rotary drive for a winding roll.

In the case of a winding body, for example a winding roll, of the winding device, a path sensor for detecting the respective wound or unwound section of the traction member is provided by the positioning drive.

For an exact length determination or determination of the path of a wound or unwound strand of the tension member by measuring the revolutions of a winding body, in particular a winding roll, a determination of the respective winding status is advantageously provided, such that the influence of the respective winding diameter on the length of the unwound section of the traction member is detected during a rotation of the winding body winding the traction member. For this purpose, an optical sensor, a camera or the like can be provided, for example.

In connection with the unwinding and winding up of the traction member, it has already become clear that it is advantageous if the traction member does not sag. It is advantageous if at least one tensioning element, for example a tensioning roller or the like, is present for tensioning the traction member. The tensioning member is expediently spring-loaded. The tensioning member can for example be arranged between the winding device and the working device.

Furthermore, the tensioning member, for example a tensioning roller, can be arranged between a traction member drive and the winding device which winds and unwinds the traction member. This allows, for example, exact winding and unwinding of the traction member from a roller or some other winding body of the winding device.

Furthermore, a traction member guide device with a traction member guide body for guiding the at least one traction member is expedient. The traction member guide body can be arranged in a stationary or movable manner on the holding device, for example. The traction member guide body comprises, for example, a guide eye, a guide roller, a guide groove or the like.

The traction member guide body is also advantageously arranged on a joint, for example a ball joint, a swivel joint, a universal joint or the like, wherein the joint movably supports the traction member guide body. The traction member guide body can follow the respective movements of the traction member on the basis of the articulated mounting. For example, the joint is provided on the at least one holding device. The joint can be provided, for example, on a longitudinal end region of the holding device. It is also possible that the joint can be fastened in place relative to the surface to be processed independently of the holding device, for example using a suction device, a screw connection, clamping or the like.

The traction member guide body is expediently arranged between a winding device for the traction member and/or a drive for the traction member and the mobile working device. Thus, the traction member guide body guides the traction member, for example, between the winding device and the working device or the drive for the traction member and the working device.

Various methods are suitable for fastening the holding device in place. For example, a vacuum clamp or similar other vacuum holding device can be provided for fastening the holding device in place relative to the room to be processed. Clamping the holding device between opposing surfaces, for example a floor and a ceiling of the room, is preferred. For example, the holding device is or can be clamped by means of a brace between the floor and the ceiling.

It is preferred if the holding device is longitudinally adjustable with respect to its longitudinal extension between at least two longitudinal positions in which the longitudinal ends of the holding device are at different distances from one another. The longitudinal ends are then supported, for example, on the floor and the ceiling of the room. The holding device can be fixed in the respective longitudinal positions, for example by means of a clamping device, a screw thread, or similar other fixing device.

The holding device comprises, for example, a type of stand or support.

The holding device comprises, for example, a holding base and a support body, which can be fastened to one another with respect to the longitudinal extension of the holding device in at least two longitudinal positions of the support body relative to the holding base. For example, the support body is telescoping on or relative to the holding base. It goes without saying that several, telescopically adjustable components of the holding device can be provided.

The working device expediently has a guide device with at least one guide contour, for example a guide surface, for guiding on the surface of the room or workpiece. The guide contour expediently has a flat shape. The guide contour can, for example, lie in one plane. The guide contour can be an elastic or flexible guide contour. But it is also possible that the guide contour is or includes a hard, non-flexible contour.

The work tool or the coating tool is expediently mounted movably relative to the guide device. Thus, for example, the guide contour can follow the surface, while the work tool or coating tool can follow uneven spots of the surface to be processed. It is of course also possible that the plate tool has a certain flexibility, for example has a foam layer that adapts to the respective surface contour of the surface, so to speak, or follows this surface contour.

It is possible that only the work tool or the coating device, in particular the coating tool, is mounted movably relative to the guide device. But it is also possible for the working device as a whole to be movably supported with respect to the guide device. Thus, the working device can form, for example, a drive unit or a drive head which is mounted movably relative to the guide device.

Movable mounting of the working device or its work tool or coating device relative to the guide device makes it possible, for example, that the working device, the work tool or the coating device on the guide device is linear with respect to the at least one guide contour using a bearing device and/or be pivotable, for example multi-axis pivotable or floating. A floating mounting is particularly to be considered as multi-axial pivotability. The storage device supports the work tool, the coating device, or the working device as a whole, preferably pivotable about at least one pivot axis which runs transversely to an axis of rotation of the work tool or to the force component oriented in the normal direction of the surface. A gimbal or ball-and-socket bearing is advantageous, for example.

In an advantageous storage concept, the storage device comprises at least one membrane on which the work tool, the coating device, or the working device is held as a whole on the guide device. For example, the edge region of the membrane is held on the guide device and carries the work tool, the coating device, or the working device arranged in the interior of the guide device as a whole.

The movable storage of work tool and/or coating device relative to the guide device also enables these to be brought into a kind of parking position, for example, which is useful when the working device is stationary with respect to the surface to be processed, for example for prepositioning before the actual work process begins or during work breaks. Then a surface treatment, for example a coating, an abrasive treatment or the like is not possible or useful. Both of these could damage or destroy the surface.

A preferred concept therefore envisages that the work tool or a coating tool of the coating device can be adjusted with respect to the guide device relative to the guide contour of the same between a working position intended for contact with the surface and a rest position shifted back relative to the at least one guide contour. In the rest position, the guide contour is in contact with the surface, while the work tool or coating tool is at a distance from the surface. The rest position is suitable, for example, for prepositioning the working device on the surface.

It is possible that the work tool or coating tool is manually adjustable by an operator between the rest position and the working position. The working device preferably has an actuator for adjusting the work tool or coating tool between the rest position and the working position. The actuator can for example comprise a lever mechanism which can be operated manually. However, the actuator is preferably motorized, in particular by an electric motor. This enables automation, among other things.

The work tool or coating tool is loaded with respect to the guide device into a working position provided for contact with the surface by a spring arrangement. Thus, the spring arrangement, which comprises one or more springs, in particular helical springs, leaf springs or the like, keeps the work tool or coating tool in contact with the surface to be worked. It is possible that the aforementioned actuator actuates the work tool or coating tool against the force of the spring arrangement into the rest position.

The guide device expediently has a guide support on which a contact body, for example a sealing body, a rubber seal, a brush seal or the like, which has the at least one guide contour and is provided for contact with the surface to be processed, is movably mounted. The guide device can thus have a so-called stiff or rigid guide carrier on which the work tool, the coating device, or the working device as a whole is movably mounted. The contact body is expediently spring-loaded by a spring arrangement with respect to the guide carrier in the direction of the surface to be processed. However, it is also possible for the contact body to be mounted, so to speak, in a floating manner with respect to the guide carrier, such that it can pivot in a multi-axial manner relative to the guide carrier. A spring load is optionally possible in this situation, but not absolutely necessary.

The guide contour expediently surrounds the working device in an annular manner. The guide contour can be an elastic guide contour, but also a fixed one. The guide contour can be formed by one or more contact bodies, in particular plate bodies, sealing bodies or the like.

The guide device expediently has at least one suction region for suction onto the surface to be processed. The suction region can be located to the side of the work tool or coating tool, for example. The suction region can surround the work tool or coating tool in an annular or partially annular manner.

However, it is also possible for the working device to, so to speak, suction onto the surface to be processed by means of the work tool. A suction region of the guide device and a further suction region on the work tool or coating tool are easily possible.

The working device is preferably received in a suction housing. The suction housing is intended for suction onto the surface. The suction housing can enclose or encapsulate the working device as a whole. For example, the guide contour already mentioned for guiding the surface to be processed is arranged on an edge region or an end face of the suction housing. The suction housing can, for example, be designed in the manner of a bell. A vacuum chamber in which the working device is accommodated is preferably provided in the suction housing.

It is preferred that the surface treatment system has a vacuum generator which is separate from the working device and which is connected to the working device by means of a suction hose. The vacuum generator is, for example, a vacuum cleaner. It is advantageous if a controller of the surface processing system is on board the vacuum generator. The vacuum generator can, for example, be arranged in a stationary manner in a room, while the working device is mobile and is positioned at the surface to be processed. The controller or control device on board the vacuum generator can, for example, control positioning drives on board the working device or on one or more of the holding devices.

It is preferred that the working device has a suction controller or a regulating device or both for setting a negative pressure in a suction region provided for suctioning the working device onto the surface. For example, the vacuum generator arranged on board the working device can be activated or regulated accordingly. For example, a pressure sensor is provided in the suction region.

The suction device expediently has at least one valve for controlling an intake air flow and/or a negative pressure in a suction region of the working device for suction onto the surface, wherein the at least one valve has a valve member which is adjustable between at least two valve positions in which a flow cross-section of the valve is different.

To achieve the object, the suction device in a mobile machine tool of the type mentioned comprises a suction controller for adjusting the valve member during operation of the work tool or the coating device between its valve positions depending on at least one physical variable.

A basic idea here is that the suction control, which can also be referred to as an adjusting device, dynamically readjusts the valve member, so to speak, while the work tool or the coating tool processes the surface, for example abrasively processes or coats the same. The valve member can be or is driven without the direct influence of the operator, namely by the suction control.

To adjust the valve member, for example, a valve drive, a spring arrangement, or both can be provided. However, it is also easily possible that the valve also has a manually operable operating handle in order to operate the valve member. The valve member, which is driven by a motor or by the spring arrangement, can also be operated manually.

The manual operating handle can also be used to change a bias of the spring arrangement, for example in order to set the valve to a different working range.

The at least one physical variable includes, for example, an angular position of the working device in relation to an underlying surface. The suction controller adjusts the valve member depending on the valve position of the working device in relation to the underlying surface. So if, for example, the working device assumes a vertical working position, for example for processing a side wall surface, the valve member has a different position than when processing a surface on the floor or processing a surface of a ceiling surface.

To determine the angular position, the suction control can have a position sensor.

The position sensor is designed to detect an angular position of the working device in relation to an underlying surface as the at least one physical variable. The position sensor can be an acceleration sensor. The acceleration sensor can carry out a tri-axial acceleration measurement.

However, it is possible that the valve member itself, so to speak, detects the angular position of the working device relative to the underlying surface or adjusts itself as a function of the angular position. The valve member is mounted, for example, in a valve housing of the valve for movement between at least two valve positions as a function of an angular position of the working device to an underlying surface. The valve member automatically assumes the valve positions by moving the working device into a respective angular position. The valve member comprises, for example, a ball or some other rolling body or bearing ball which is movably mounted within the valve housing. Depending on the angular position of the working device and thus of the valve, the valve member moves within the valve housing, for example in order to open or close a valve passage opening. Several such valve members can be provided.

The at least one physical variable can also include a motor output or a motor current of the drive motor. The at least one physical variable can therefore also represent an abrasion performance or a polishing performance of a work tool. The suction controller is designed to control the valve or to adjust the valve member as a function of the motor power or the motor current. So if the motor produces a higher output, for example, this can be an indicator of a high abrasion performance, which in turn is due to the fact that the negative pressure in the suction region is high.

The at least one physical quantity can also be a pressure and/or include a flow rate of an intake air flow in the suction region. For this purpose, the suction controller has, for example, a pressure sensor for detecting the pressure and/or a flow sensor for detecting the flow rate.

It is also possible that the valve member is automatically controlled, so to speak, by the pressure or the flow, that is, for example, that the valve member is spring-loaded in the direction of a closed position and can be opened by negative pressure or is spring-loaded in the direction of an open position and closed by negative pressure.

It is preferred that the suction controller comprises a regulating device for regulating a negative pressure in the suction region as a function of the at least one physical variable. The regulation can include, for example, a pressure signal or flow signal from the pressure sensor or flow sensor as an input variable. On the output side, the regulating device controls, for example, a motorized valve drive in order to operate the valve member.

Using the valve, the suction controller can, for example, set or regulate an intake air flow that is drawn in through the suction region when the machine tool is in operation. But it is also possible that the valve is used to control external air, that is to say, for example, that external air flows into the suction region or some other negative pressure region that is flow-connected to the suction region in order to change the negative pressure or the flow rate of the intake air flow in the suction region, for example, to increase or decrease it.

It is easily possible for the suction device to have at least one other manually operable valve for influencing the negative pressure and/or the intake air flow in the suction region. The valve is therefore present in addition to the valve that can be operated by the suction controller. For example, an external air inlet can be opened or closed or partially opened with the valve by the operator of the machine tool. In this way, for example, a working range of the valve that can be operated by the suction controller can be changed.

Figure 2:
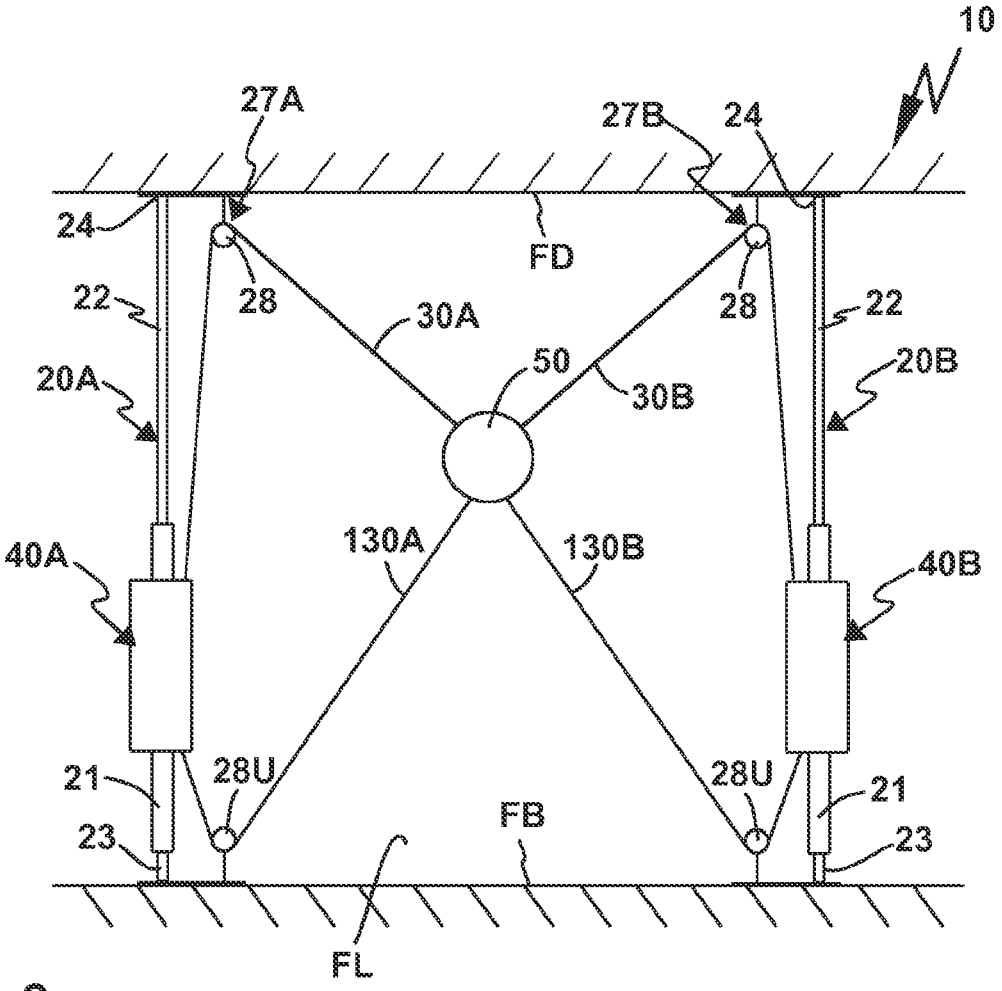
Figure 3:
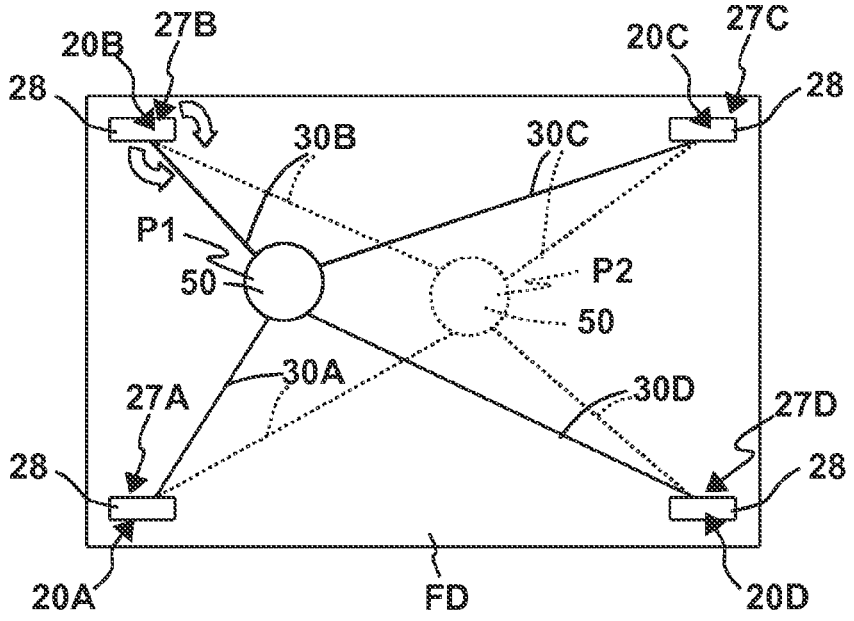
Figure 4:
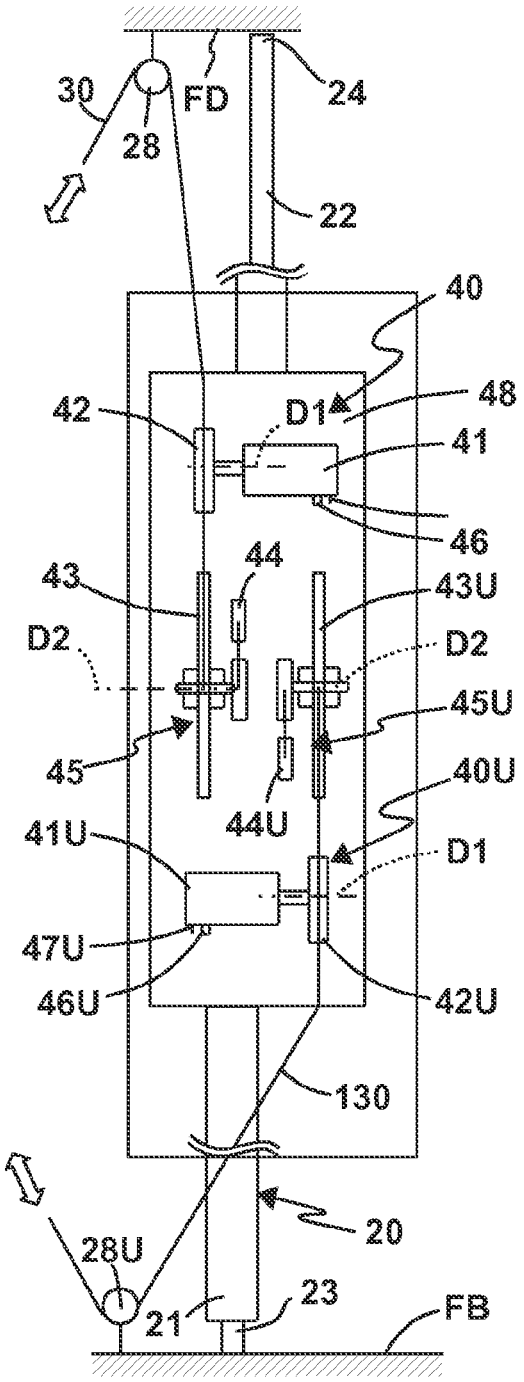
Figure 5:
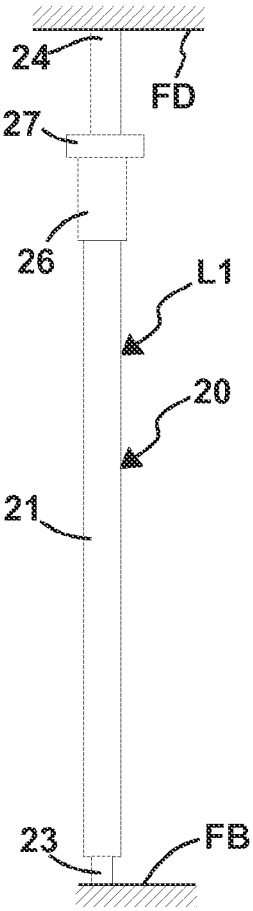
Figure 6:
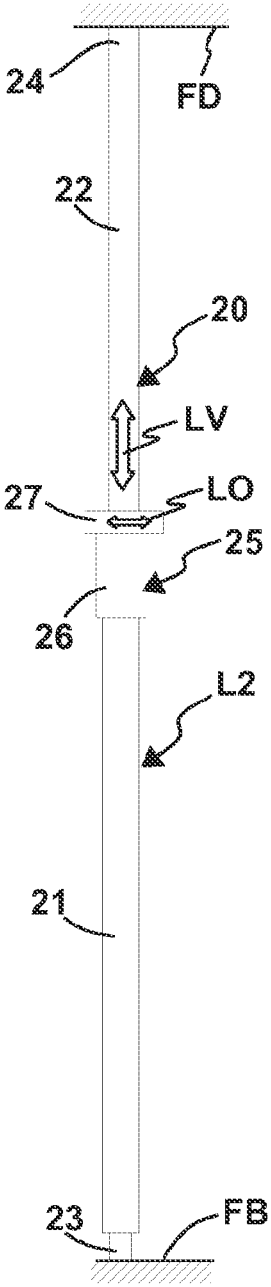
Figure 7:
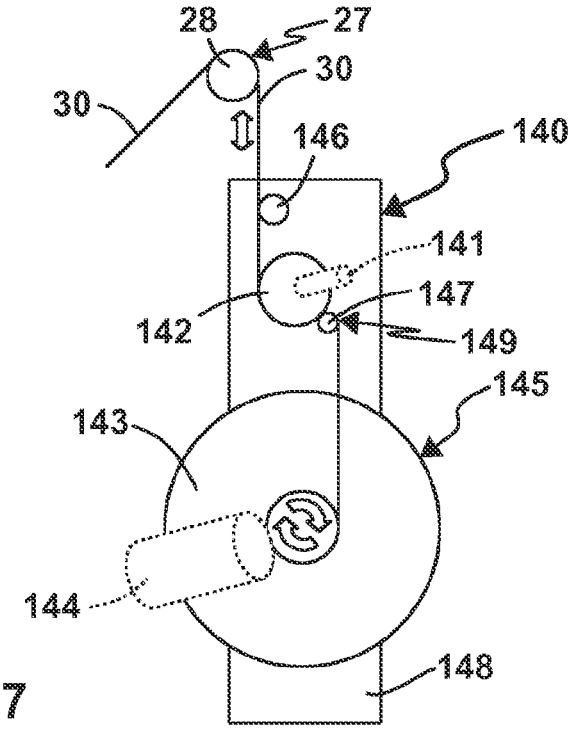
Figure 8:
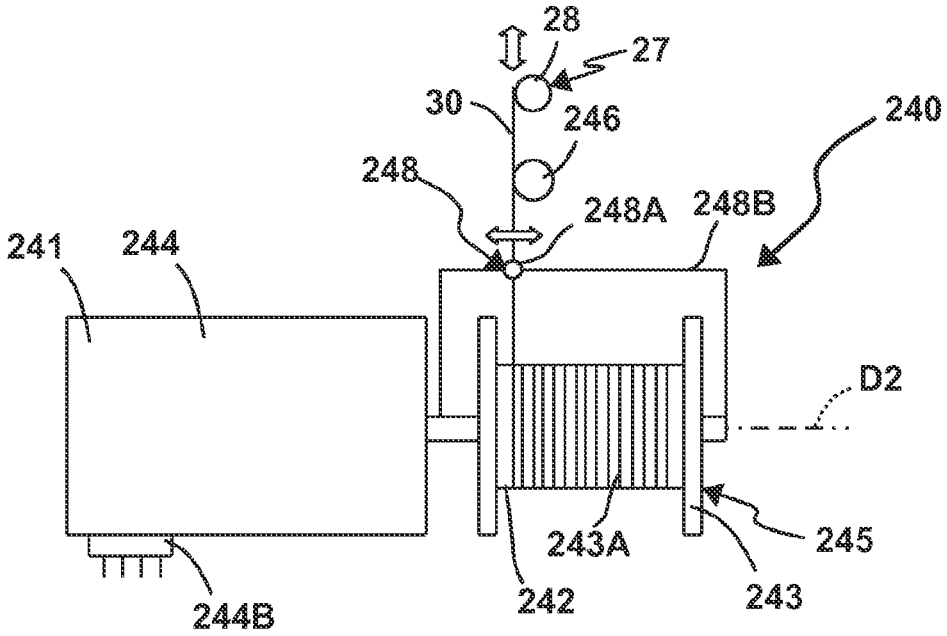
Figure 9:
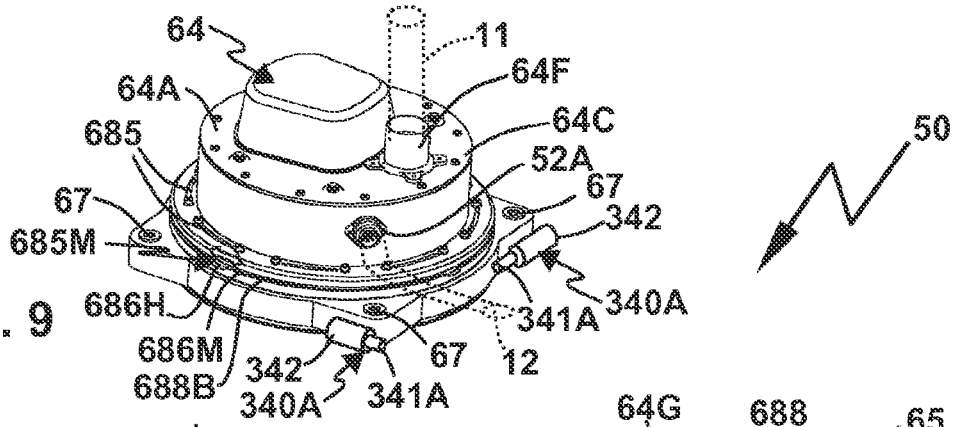
Figure 10:
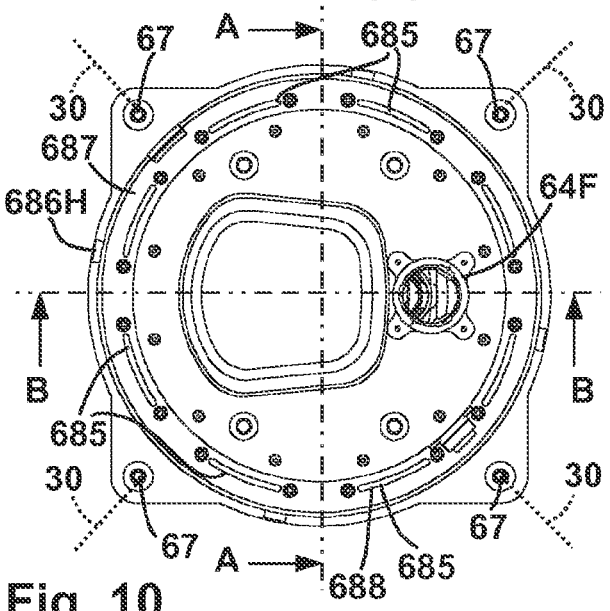
Figure 11:
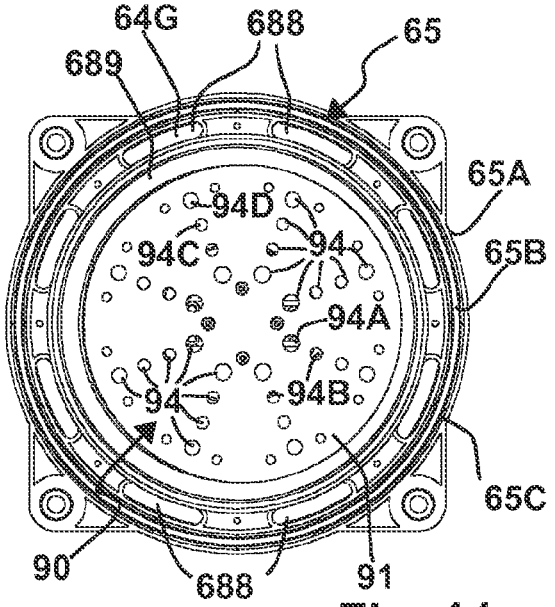
Figure 12:
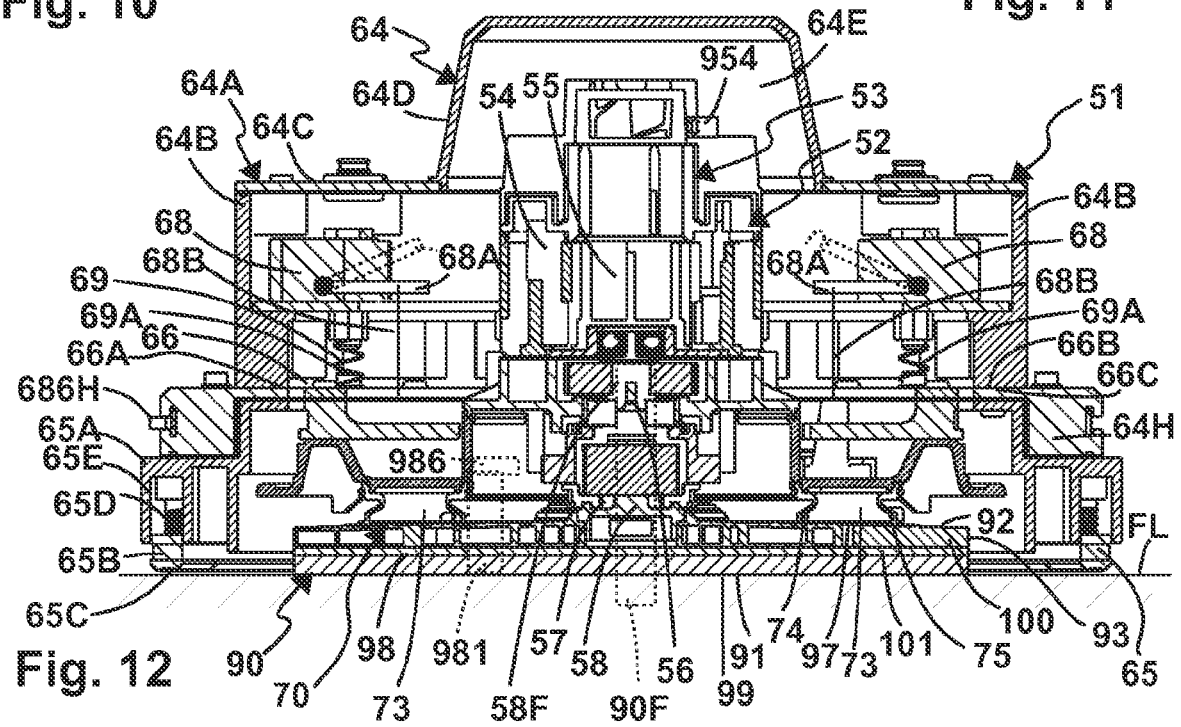
Figure 14:
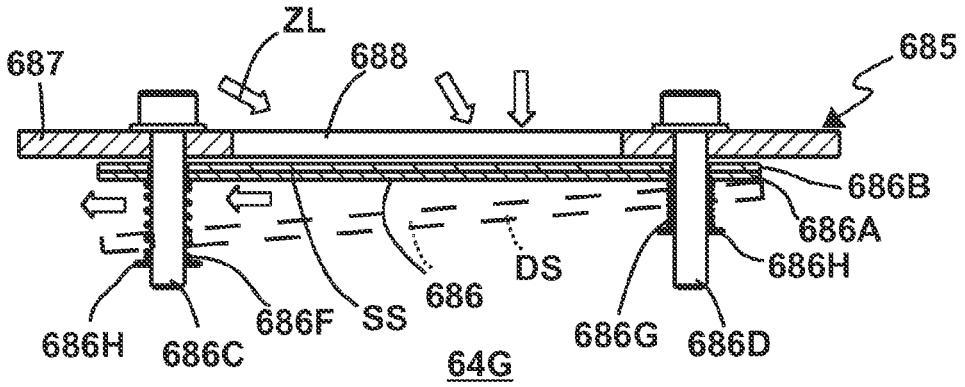
Figure 13:
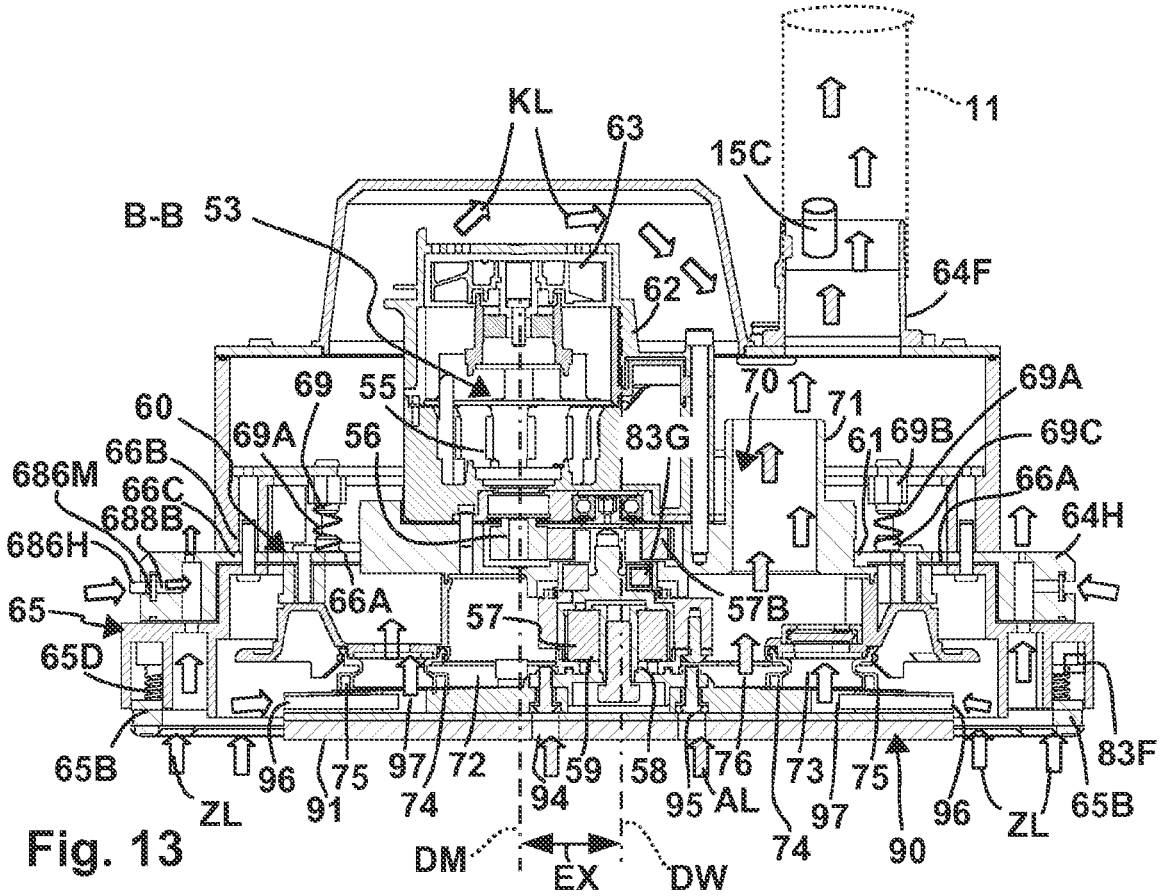
Figure 15:
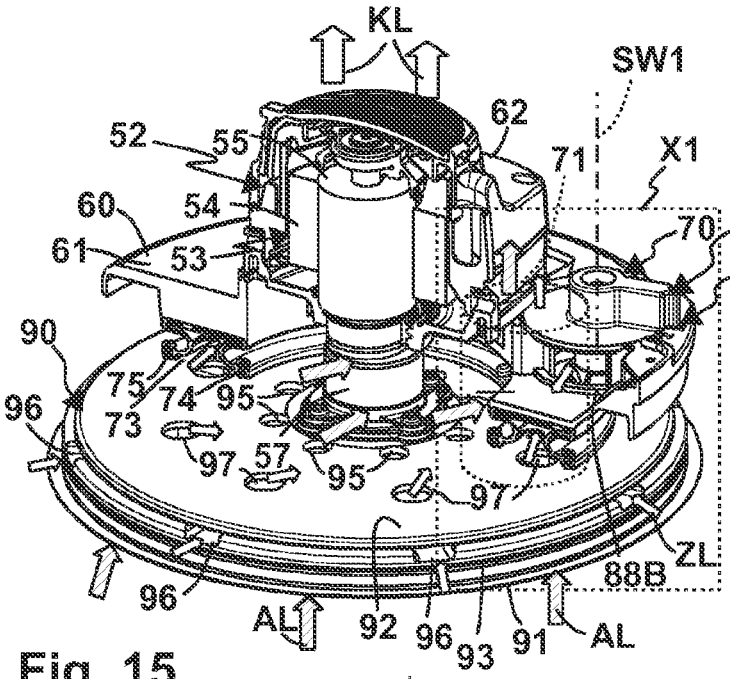
Figure 16:
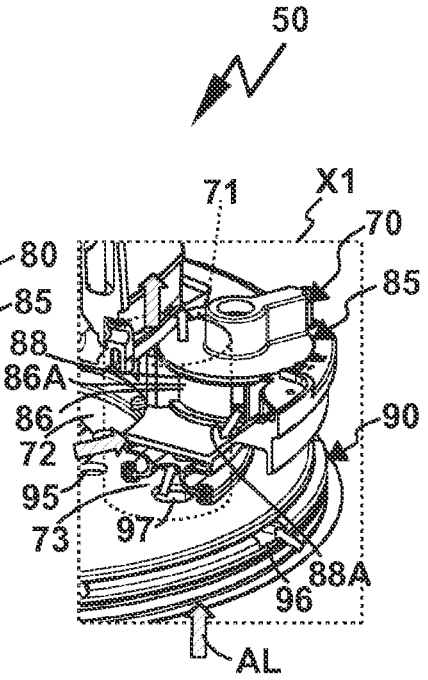
Figure 17:
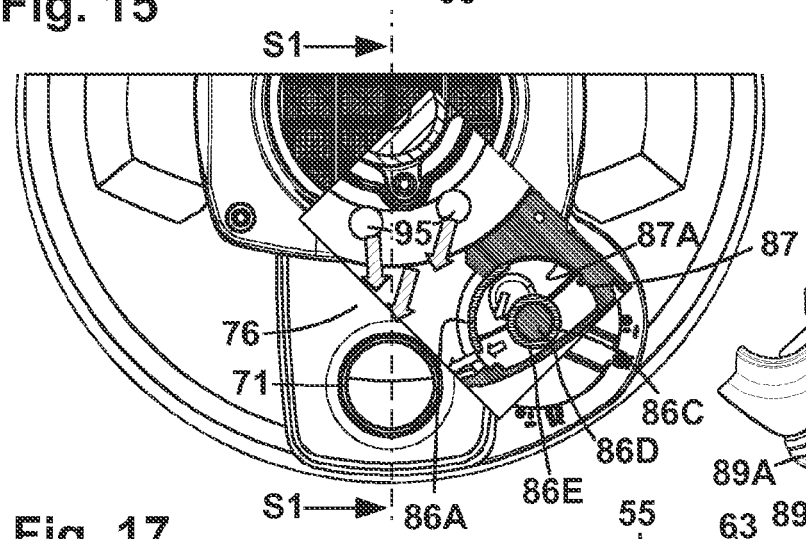
Figure 19:
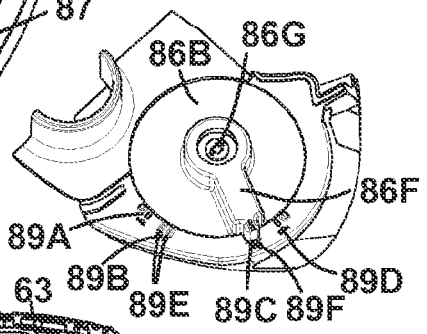
Figure 18:
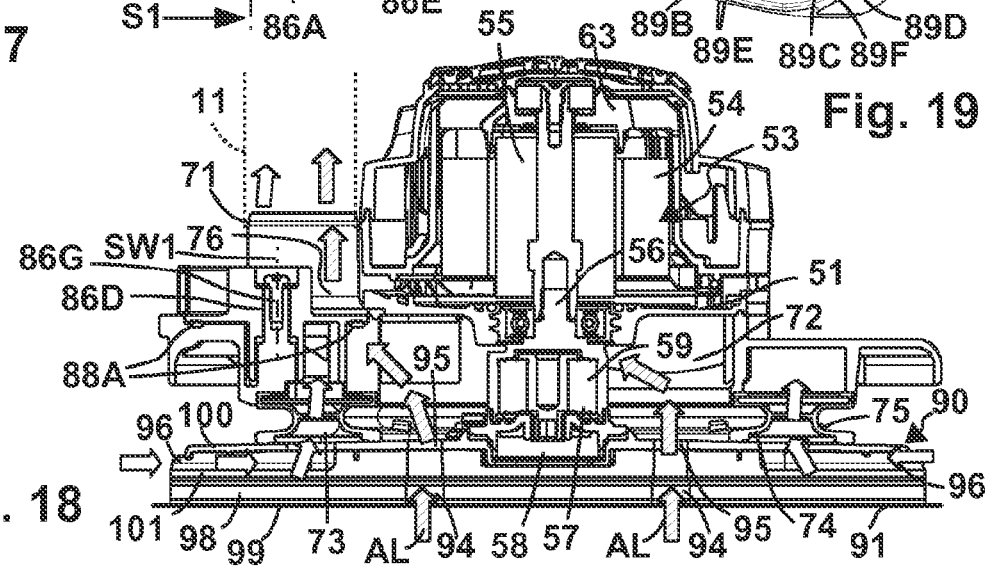
Figure 20:
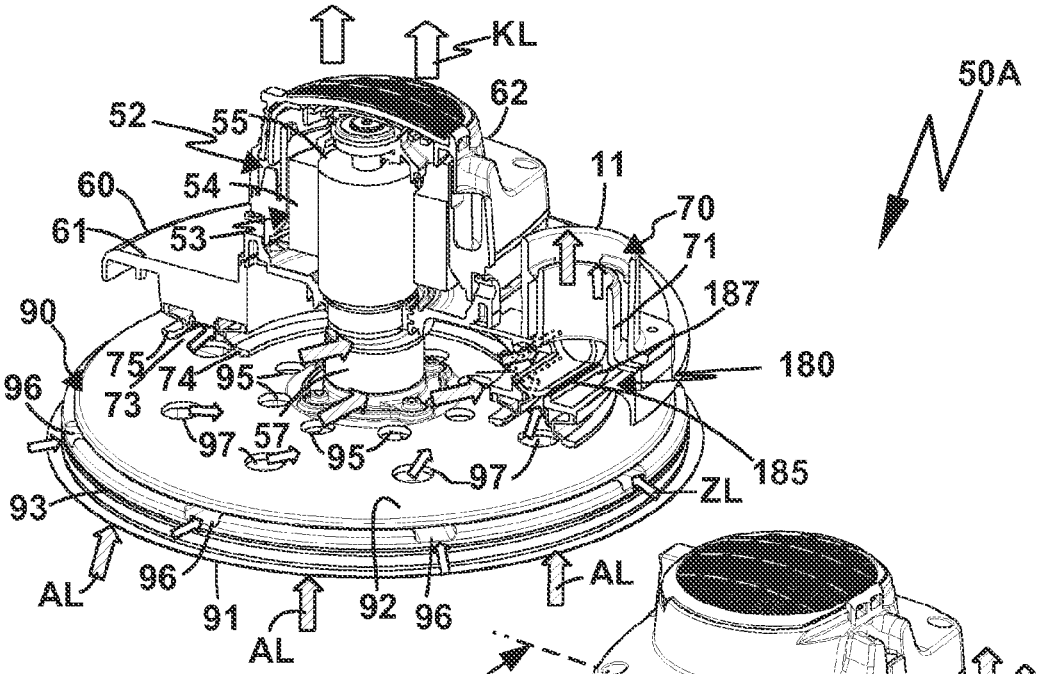
Figure 21:
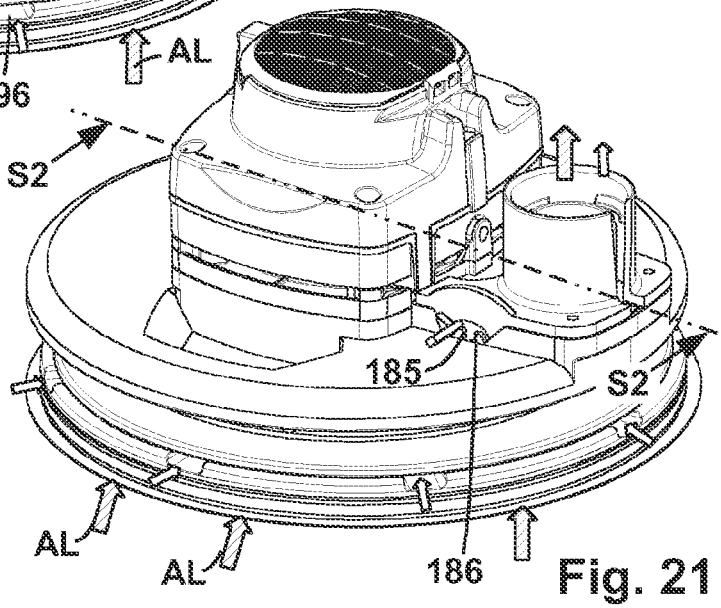
Figure 23:
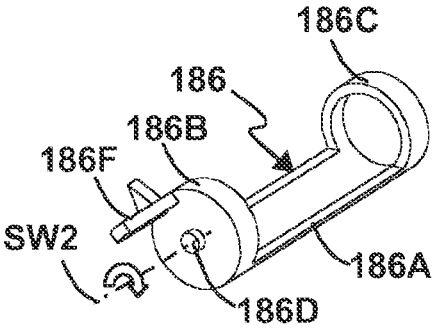
Figure 22:
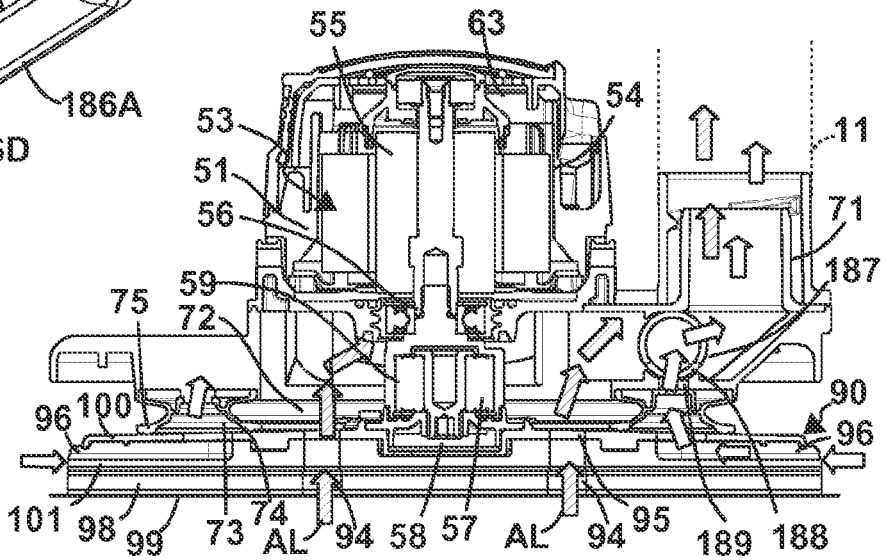
Figure 24:
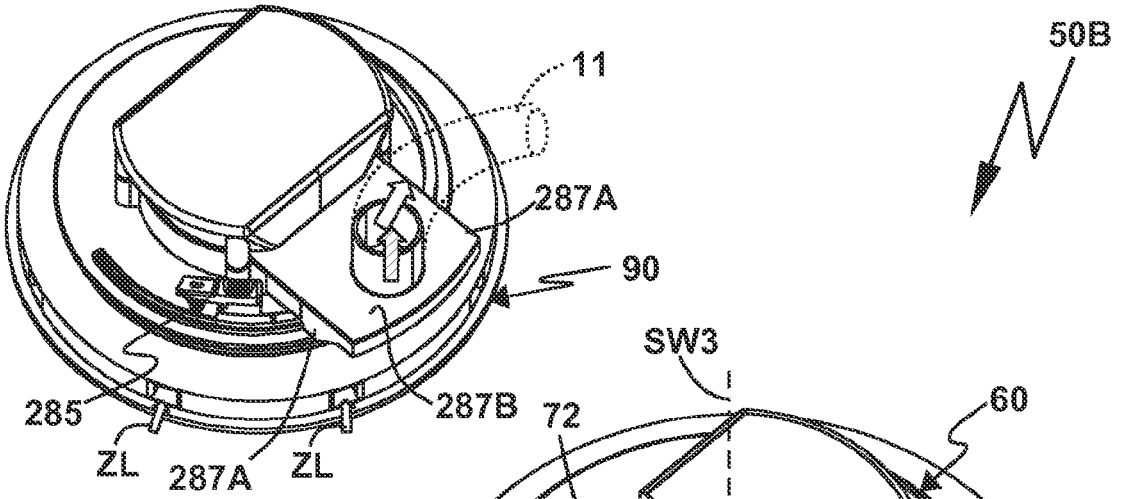
Figure 25:
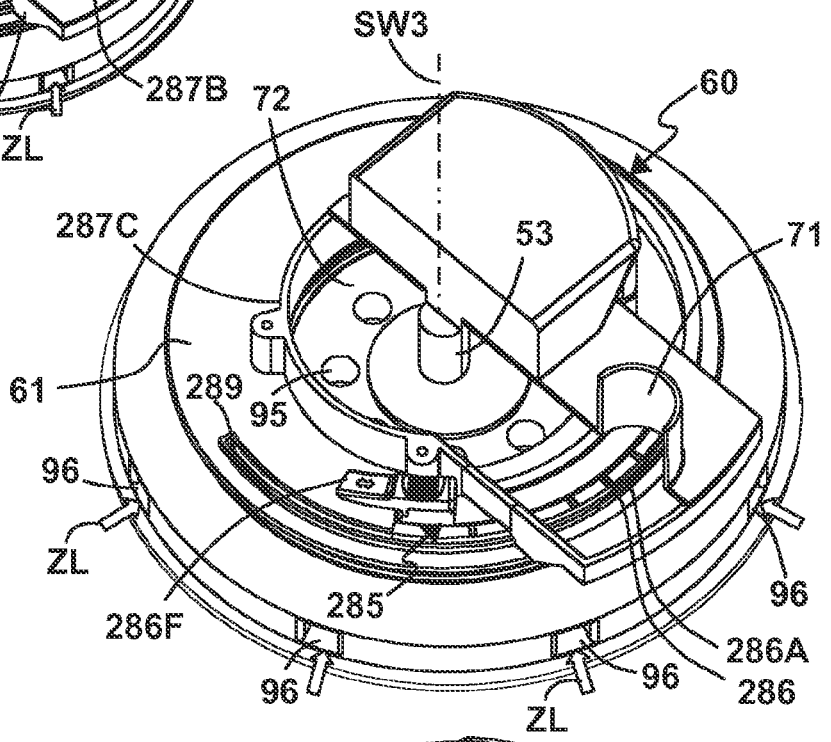
Figure 26:
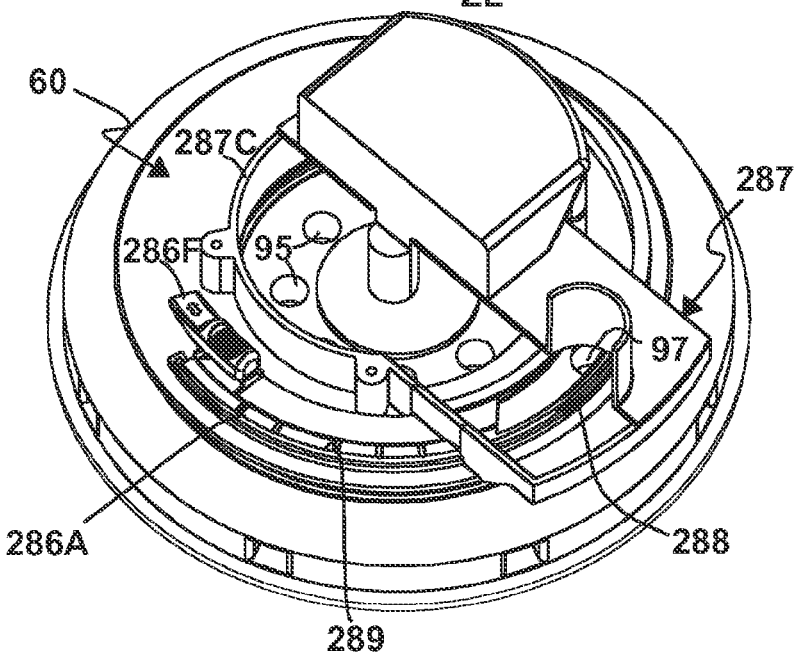
Figure 27:
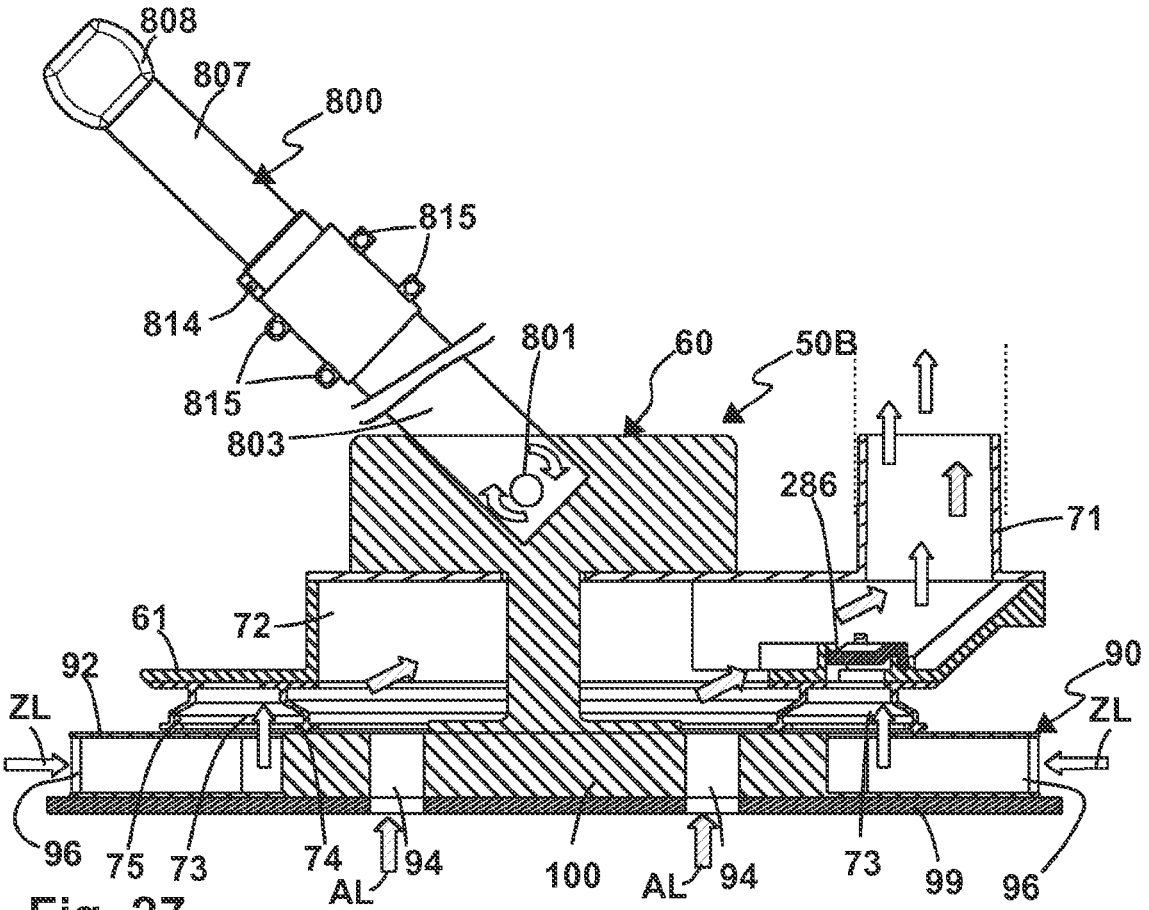
Figure 28:
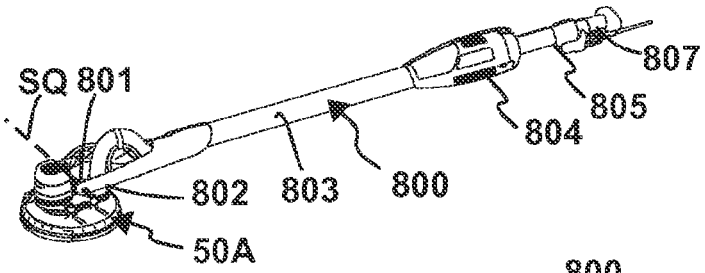
Figure 29:
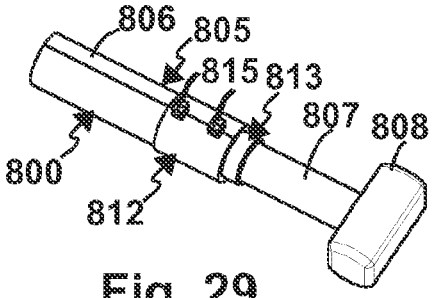
Figure 30:
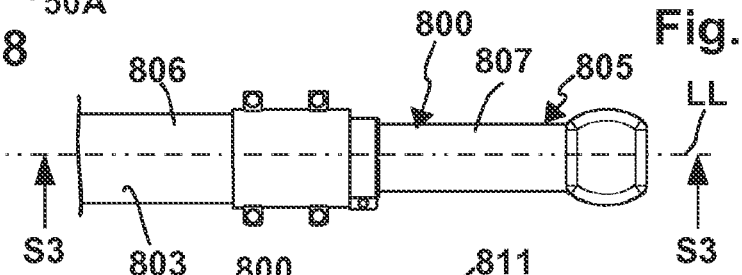
Figure 31:
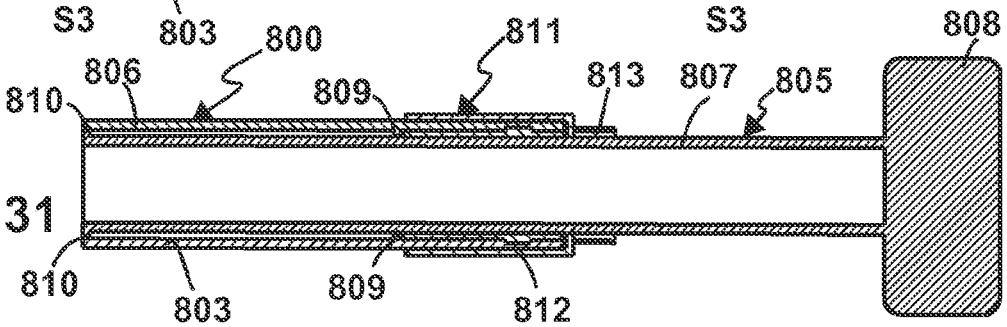
Figure 32:
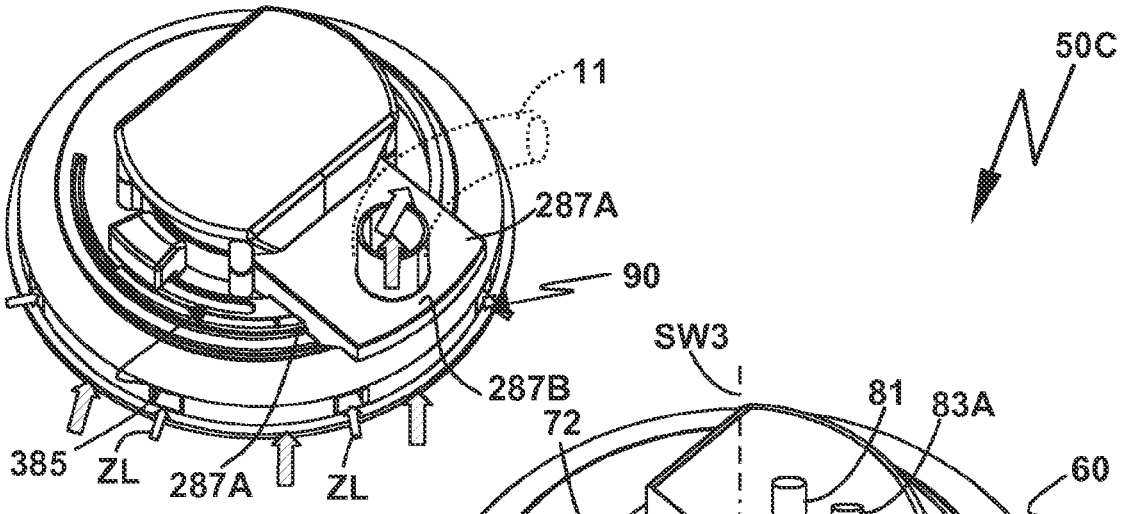
Figure 33:
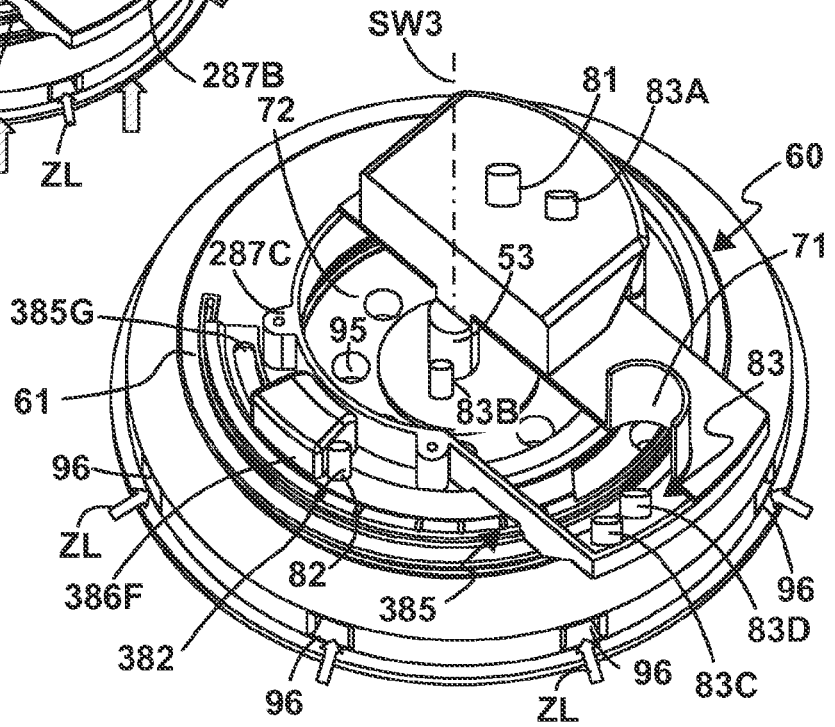
Figure 34:
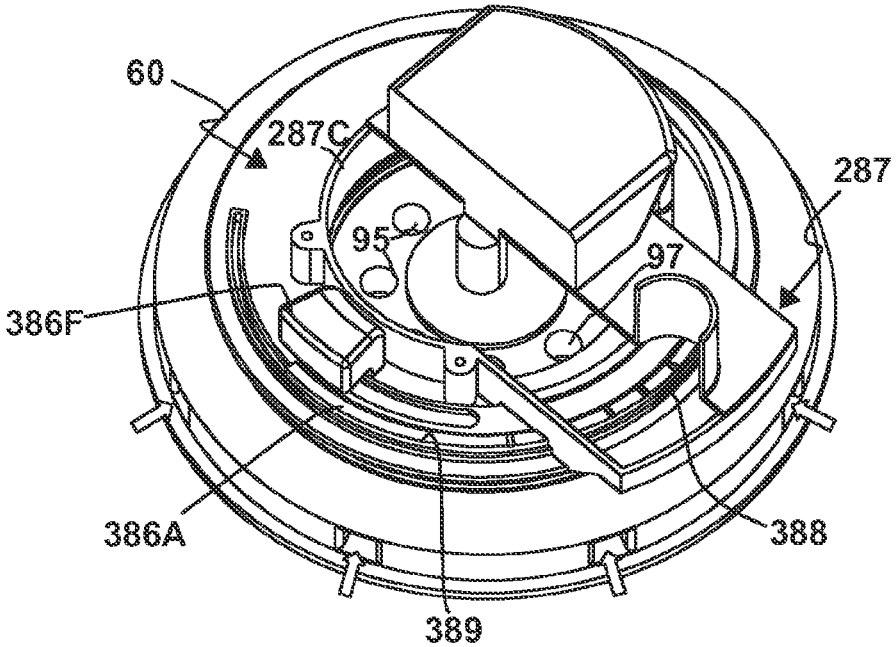
Figure 35:
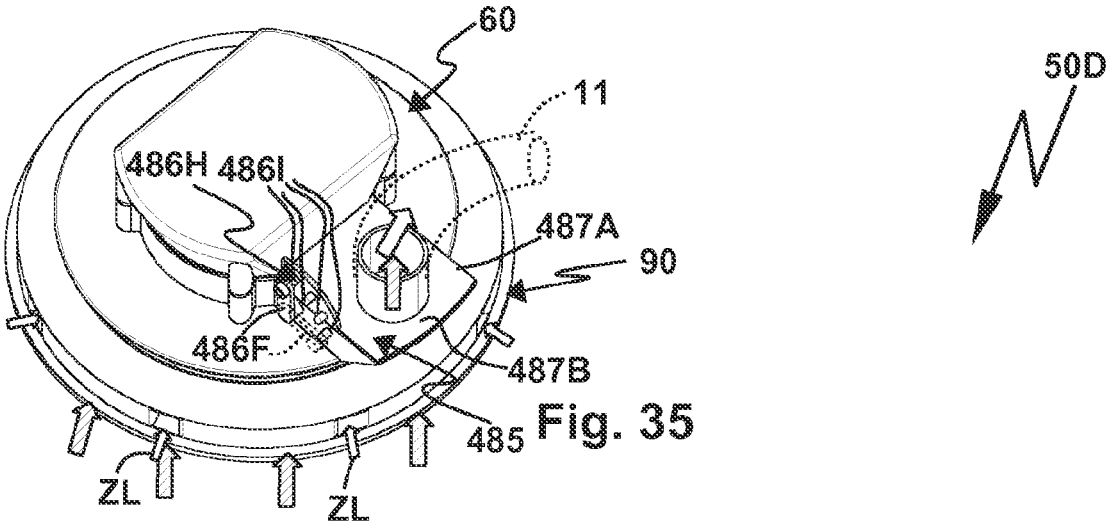
Figure 36:
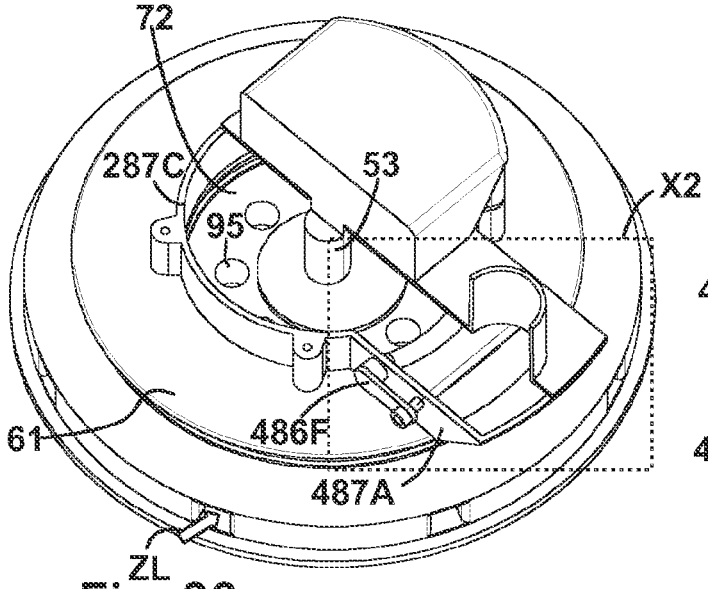
Figure 37:
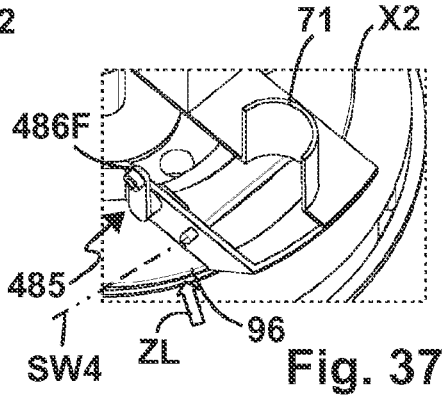
Figure 39:
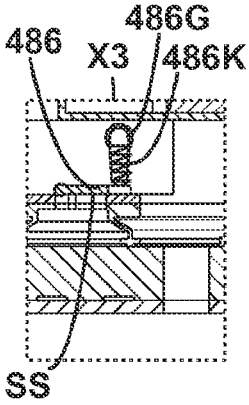
Figure 38:
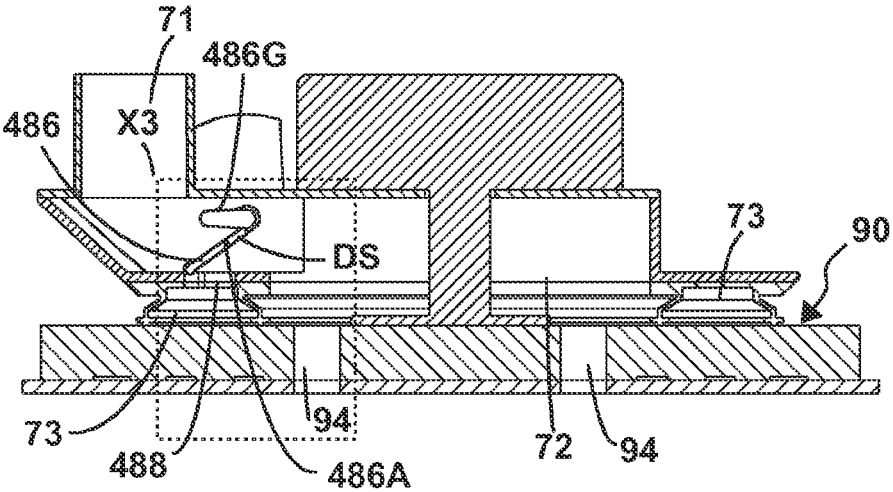
Figure 40:
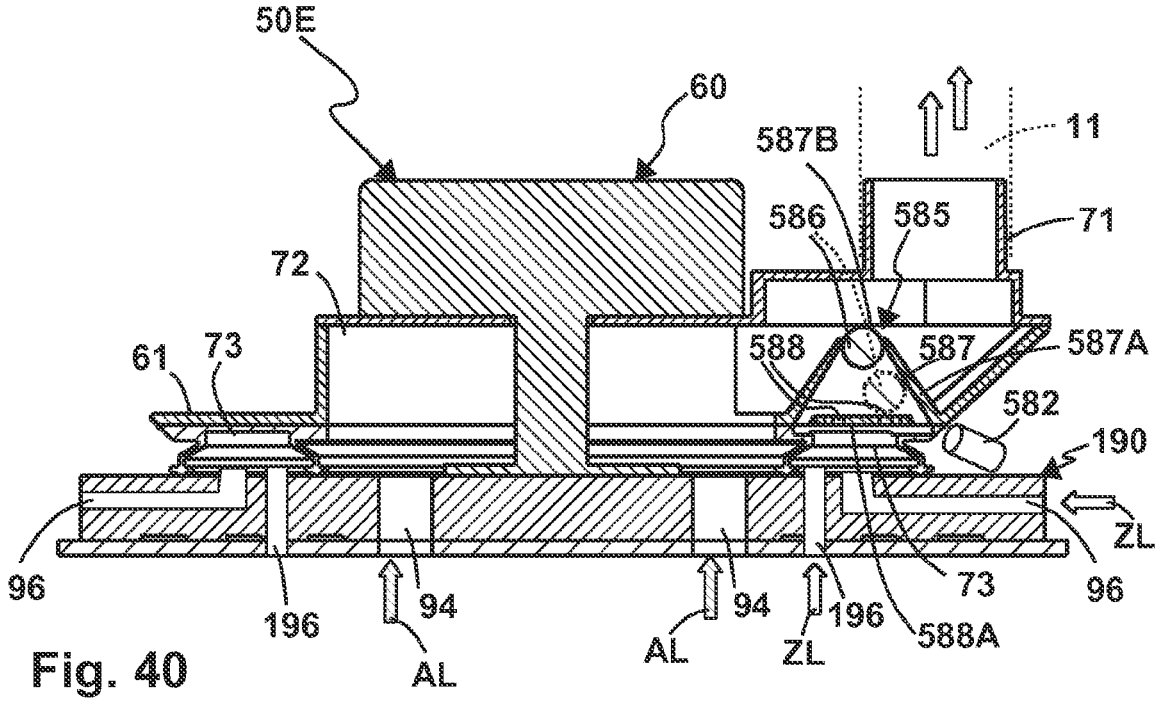
Figure 41:
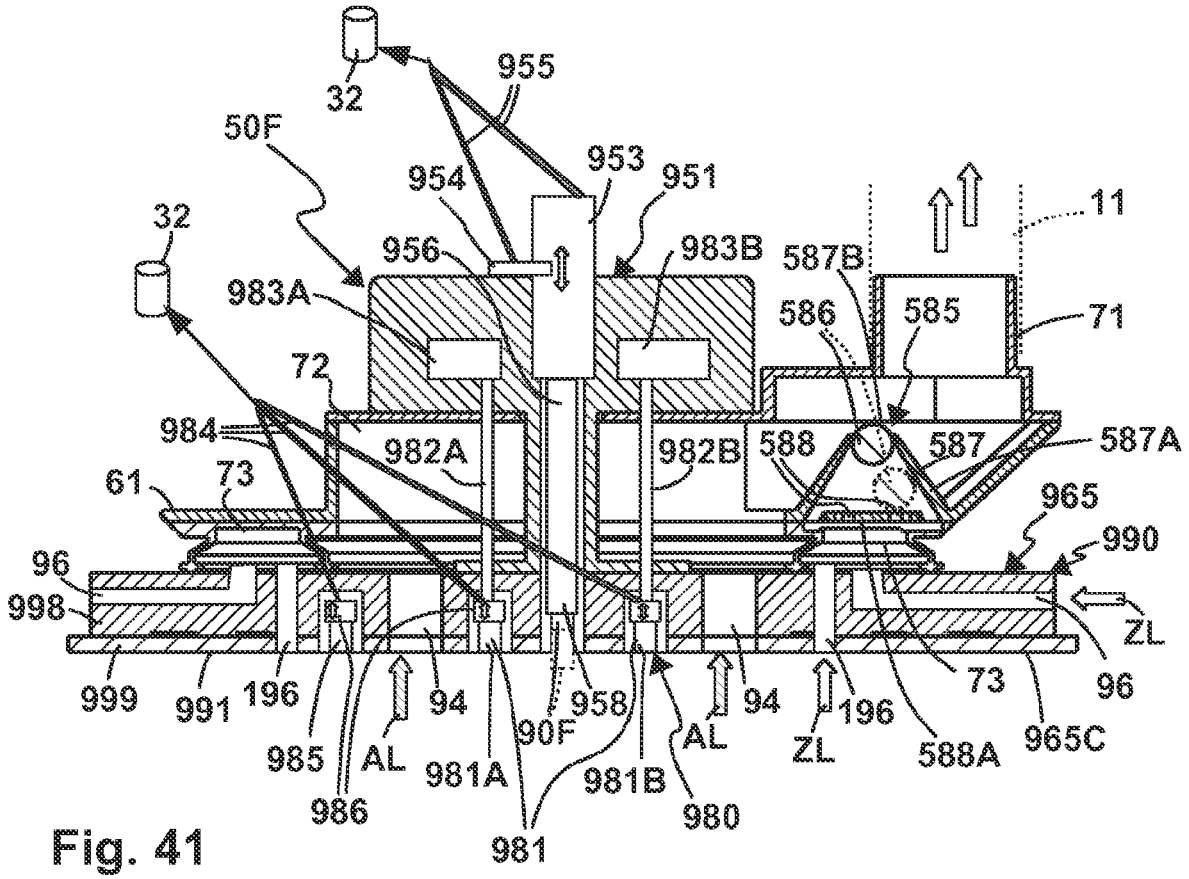

Exemplary embodiments of the invention are explained below with reference to the drawing. Wherein:

FIG. 1 shows a perspective view of a surface processing system which is arranged in a room having at least one surface to be processed, FIG. 2 shows a side wall of the room according to FIG. 1, on which two holding devices and the working device of the surface treatment system according to FIG. 1 are shown in a processing situation for processing the wall surface, FIG. 3 shows a schematic bottom view towards the ceiling of the room according to FIG. 1, with the working device processing the ceiling of the room, FIG. 4 shows a schematic view of a holding means of the surface treatment system according to the preceding figures, with a positioning drive and a flexible traction member, FIG. 5 shows a holding device of the surface processing system in a first longitudinal position, FIG. 6 shows the holding device according to FIG. 5 in a second longitudinal position, FIG. 7 shows a first schematic view of a winding device of the surface processing system according to the preceding figures, FIG. 8 shows another winding device of the surface processing system according to the preceding figures, FIG. 9 shows an oblique perspective view of the working device of the surface processing system, which is shown in FIG. 10 from above and in FIG. 11 from below, FIG. 12 shows a cross section through the working device approximately along a section line A-A in FIG. 10, FIG. 13 shows another cross section through the working device of FIG. 10 along a section line B-B, FIG. 14 shows a valve for controlling a negative pressure in a suction region of the working device, FIG. 15 shows a mobile machine tool with a valve of a first type for controlling an intake air flow, FIG. 16 shows a detail X1 from FIG. 15 with the valve in a different valve position, FIG. 17 shows a plan view of the machine tool according to the two preceding figures, with a partial cutout, FIG. 18 shows a detail view of the valve of the machine tool according to the three preceding figures, FIG. 19 shows a section through the machine tool according to the preceding figure taken substantially along a section line S1-S1, FIG. 20 shows a machine tool with another valve for controlling an intake air, which in FIG. 21 is shown in partial section and with a different suction controller of the valve, FIG. 22 shows a section through the machine tool according to the preceding figure, taken substantially along a section line S2-S2, FIG. 23 shows a valve member of the valve of the machine according to the preceding figure, FIG. 24 shows another machine tool having a valve for controlling the intake air flow, which is shown in FIG. 25 in a partial sectional view in a first valve position of the valve and in FIG. 26 in the same partial sectional view, but with a different valve position of the valve, FIG. 27 shows a section through the machine tool of the three preceding figures, approximately along the cutting line of the partial section, FIG. 28 an oblique perspective view of the machine tool according to FIG. 27 with a rod-shaped handle, of which FIG. 29 shows a perspective view of a telescoping section and FIG. 30 shows a side view, FIG. 31 shows a longitudinal section through the arrangement according to the preceding figure, approximately along a section line S3-S3, FIG. 32 shows a machine tool with another valve for controlling the exhaust air flow, which is shown in FIG. 33 in a perspective view from above and in partial section in a first valve position of the valve, and is shown in FIG. 34 with a second valve position of the valve, FIG. 35 shows a machine tool with another valve for controlling the intake air flow, which is shown in FIG. 36 in a partial sectional view, the valve being in a first valve position, FIG. 37 shows an excerpt X1 from the preceding figure with the valve in a different valve position, FIG. 38 shows a sectional view approximately along the partial sectional plane in the two preceding figures, wherein the valve assumes a passage position, and FIG. 39 shows an excerpt X3 from the preceding figure, wherein the valve is in a blocking position, FIG. 40 shows another working device with a position-dependent valve for controlling the intake air flow, and FIG. 41 shows a working device with a cutting work tool and a coating device.

With a surface processing system 10, surfaces of a room RA can be processed, for example a floor surface FB or side wall or wall surfaces FL, FR, FF, which are angled to one another. But the surface processing system can also be used for processing a ceiling surface FD of a ceiling in the room RA. Even the processing of the side surfaces FL, FR and FF of the side walls is exhausting for an operator, and processing of the ceiling surface FD even more so. This is because in this situation, the operator must hold a working device 50 with, for example, an operating stick or other similar handle, which is strenuous in the long run and in any case time-consuming.

DETAILED DESCRIPTION

Processing the surfaces FL, FR, FF, FD is clearer with the surface processing system 10, however.

The working device 50 is held on flexible traction members 30A, 30B, 30C, 30D and also suctions itself onto the surface FL, FR, FF, FD to be processed by means of a negative pressure generated by a vacuum generator 15, for example, a vacuum cleaner 15B with at least one force component in a normal direction N of the respective surface FL, FR, FF, FD.

The vacuum generator 15 is a vacuum generator that is separate and spatially separated from the working device 50. The vacuum generator 15 is flow-connected to the working device 50 by means of a flexible suction hose 11. Alternatively or in addition to the vacuum generator 15, a vacuum generator 15C arranged locally on board the working device 50 would also be an option.

The traction members 30A-30D can only serve as a safety measure, such that in the event of a pressure drop in the negative pressure provided by the vacuum generator 15, the working device 50 does not fall to the underlying surface, i.e. falls in the direction of the floor surface FB, but these members also enable autonomous or semi-autonomous operation, that is to say that the working device 50 can be positioned on the basis of the traction members 30A, 30B, 30C and 30D in relation to the respective surface FL, FR, FF, FD to be processed.

The vacuum generator 15 is, for example, a vacuum cleaner, that is to say that it sucks existing particles into a dirt collecting container 16 when processing a respective surface FL, FR, FF, FD of the room RA. This allows, for example, low-dust or dust-free processing of the surfaces FL, FR, FF, FD. The vacuum generator 15 has a suction unit 17, for example a turbine with an electric drive motor. Like the dirt collecting container 16, the suction unit 17 is accommodated on a housing 18. The housing 18 can be fastened in place on the underlying surface, for example the surface FB, but can also be freely movable there, for example by means of rollers 19. The rollers 19 can not be driven, such that the vacuum generator 15 remains stationary around room RA, or it can also be taken along by the working device 50 when it moves along the surface FL, FR, FF, FD to be processed. It is also possible that one or more of the rollers 19 are driven, in particular controlled by a control device 32, which will be explained below, in order to follow the movements of the working device 50.

The traction members 30A-30D are held by holding devices 20A-20D. The holding devices 20 are arranged in a stationary manner in the room RA, for example at the respective corner regions of the surfaces FL-FD. In the exemplary embodiment shown in the drawing according to FIG. 1, for example, the ceiling of the room RA is processed, that is, the ceiling surface FD. Accordingly, the holding devices 20A-20D are arranged in the respective inner corners, i.e. of the room A, thus in the corner regions of the surface FD, such that a large work region or work space is spanned for the working device 50 in which the working device 50 can be freely positioned by actuating the traction members 30A-30D or by at least one positioning drive 340A, 340B on board the working device 50. Positioning drives 40A, 40B, 40C, 40D provided for actuating the traction members 30A-30D and the positioning drives 340A, 340B form components of a positioning device 13.

The holding devices 20 can be arranged in the room RA, for example they can be braced, clamped or the like. For the respective adaptation to the spatial conditions of the room RA, the holding devices 20 are adjustable, for example, their respective longitudinal ends 23, 24 can be braced between opposing surfaces of the room RA, for example the floor surface FB and the ceiling surface FD.

The holding devices 20 are designed, for example, in the manner of braces, telescoping longitudinal supports or the like. The holding devices have a holding base 21 on which a support body 22 is mounted telescopically. For example, the longitudinal ends 23, 24 can be adjusted to longitudinal positions L1 and L2, where they can then be fixed by a fixing device 25 of the holding device 20. The fixing device 25 has, for example, a fixing base 26 on which a fixing body 26B, for example a clamp or the like, can be adjusted between a fixing position that fixes, for example, locks or jams, the support body 22 and a release position that releases it, for example by means of a shifting movement or a locking operation LO. In the unlocked or released state of the fixing device 25, the support body 22 can, for example, be longitudinally adjustable, which is indicated by a double arrow or a longitudinal adjustment LV in the drawing. The fixing device 25 can be or comprise a tensioning device, that is, for example, the support body 22 can be adjusted relative to the holding base 21 by means of a screw thread or similar other tensioning means, such that the holding device 20 is clampable, in particular its longitudinal ends 23, 24, between the opposing surfaces FD and FB.

A traction member guide device 27A, 27B, 27C and 27D is arranged on a respective holding device 20A, 20B, 20C, 20D in order to guide the traction member 30A-30D. The traction member guide device 27 has, for example, a guide body 28, in particular a guide groove and/or a guide roller on which the traction member 30 is guided. The guide body 28 is preferably movably mounted on a joint 29, about at least one pivot axis, preferably about multiple pivot axes, such that it can follow the movements of the respective traction member 30A-30D. The joint 29 is preferably a ball joint, a cardan joint or the like.

The positioning drives 40A, 40B, 40C, 40D are arranged on the holding devices 20A-20D and each act on a traction member 30A-30D and operate it. To transmit a tensile force, a traction element 30 can be designed, for example, as a rope. However, a toothed belt is preferred, the respective length of which between the guide body 28 and the working device 50 can be precisely influenced or adjusted.

The positioning drives 40 have drive motors 41 which form traction member drives. The drive motors 41 drive drive rollers, in particular sprockets 42, which rotate about axes of rotation D1. The traction member 30 is guided over the drive roller 42, such that a rotary operation of the drive roller 42 by the drive motor 41 leads to a longitudinal adjustment of the traction member 30 and consequently to a positioning of the working device 50.

The traction member drives 41 are arranged between the guide bodies 28 on the one hand and a winding body 43 of a winding device 45 on the other hand. The winding device 45 winds up a section or strand of the traction member 30 that is not currently required. The winding body 43 is preferably spring-loaded by a spring arrangement 44, for example by a torsion spring. Of course, the angle body 33, for example a winding roll or a winding drum, can be driven by a drive motor in order to wind up the section of the traction member 30 between the tension member drive 41 and the angle body 43. The winding body 43 rotates, for example, about an axis of rotation D2.

A rotational speed sensor 46 is preferably provided to determine the length of that section of the traction member 30 which is adjusted by the traction member drive 41 in the direction of the winding device 45, i.e. that section with which the positioning drive 40 pulls at the working device 50. The rotational speed sensor 46 can, for example, form a component of the drive motor of the traction member drive, that is, measure the revolutions of the drive motor. It is also possible that the rotational speed sensor 46 is arranged, for example, directly on the traction member 30, for example by optical means, using a pickup roller and the like, to measure or detect the respective longitudinal adjustment of the traction member 30.

For example, the aforementioned control device 32 can control the positioning drives 40A-40D on the basis of the rotational speed information originating from the rotational speed sensor 46 or basically length information about the traction member 30. The control device 32 can be one on board the vacuum generator 15 and/or can comprise or be a control device arranged on board the working device 50.

It is also possible that the control device includes multiple parts, i.e., that parts of its components are arranged on board the vacuum generator and others are arranged on board the working device 50. These parts of the respective control device can communicate with one another.

The control device 32 can, however, also be or comprise a control device which can be positioned separately from, for example, the vacuum generator 15 in the room RA, as indicated schematically in the drawing.

For example, the control device 32 comprises a computer. The control device 32 preferably comprises input means 33, in particular a keyboard, a mouse, a touch-sensitive screen or the like, as well as output means 34, for example a screen, signal lamps or the like, other optical output means and/or acoustic output means, for example a voice output, a loudspeaker or the like. The control device 32 further comprises a processor 35 for executing program codes of programs, for example a control program 37, which is stored in a memory 36 of the control device 32. The control program 37 can be loaded from the memory 36 into the processor 35.

The control device 32 communicates with the positioning drives 40A-40D via communication links 38A-38D, for example, control lines and/or wireless connections, for example, WLAN or the like. Wired communication links 38A-38D can, for example, be bundled in sections to form a collective line or collective communication link 38.

In this way, the control device 32 can, for example, control the positioning drives 40A-40D in such a way that it can control the working device 50 between several positions with respect to the respective surface FL, FR, FF, FD to be processed. For example, the traction members 30A-30D pull the working device 50 along the ceiling surface FD, positions P1 and P2 being shown in the drawing by way of example. It is readily possible that the working device 50 moves into the corner regions towards the respective guide bodies 28 of the holding devices 20 and also along or toward the edge regions of the ceiling surface FD. If, for example, the traction members 30D, 30C between the working device 50 and the guide bodies 28 of the holding devices 20D, 20C are particularly long, the working device 50 can be moved between the holding devices 20A, 20B, for example at the edge region of the surface FD, in order to process the surface FD.

The working device 50 is freely movable along the surfaces FL, FR, FF, FD of the room RA. For example, the suction hose 11, which connects the working device 50 to the vacuum generator 15, can follow the movements of the working device 50. An electrical supply line 12, which is preferably provided between the vacuum generator 15 and the working device 50, is correspondingly flexible and follows the movements of the working device 50 on the surface FL, FR, FF, FD to be processed. The supply line 12 can be guided in or on the suction hose 11, for example it can form part of the same. The supply line 12 is connected, for example, to an electrical port 52A of the working device 50. The supply line 12 supplies the working device 50 with electric power. An energizing device 804A, which supplies the working device 50, for example an electronically commutated motor thereof, with electric power via the supply line 12, can be on board the vacuum cleaner 15, for example.

The vacuum generator 15 can be connected to a power supply network, for example an AC voltage network, via an electrical connection line 14, which has a plug, for example. The power supply network is available, for example, in room RA using an outlet into which the connecting line 14 or its plug can be plugged.

In order to position the working device 50 with respect to a side wall, for example the wall surface FL, it is advantageous if, like in several corner regions, for example in the upper and lower corner regions of the surface FL, one traction member acts on the working device 50 via a stationary traction member guide device. A configuration would now be possible in which, for example, the holding devices 20C, 20D are arranged reversed with respect to their horizontal position in the room RA, such that their respective guide bodies 28 are arranged in the region of the floor or floor surface FB, close to the wall surface to be processed FL. For example, one of the holding devices 20C, 20D, the positioning drives 40 of which can then, so to speak, pull from below using a traction member 30 on the working device 50, can be arranged in addition to the holding devices 20A and 20B.

However, it is an advantageous concept if a second positioning drive, for example a positioning drive 40U, is arranged, so to speak, on a respective holding device 20, for example the holding devices 20A, 20B. The positioning drive 40U acts via a traction member 130A, 130B on the working device 50 when it is active on a side wall surface FL, FR, FF. For example, the positioning drives 40U also include the same or similar components as the positioning drives 40, such that, for example, a traction member drive 41U acts on the traction member 130 by means of a drive roller 42U, which can be wound onto a winding body 43U, so to speak, in a downward winding direction or downstream of the traction member drive 41U. The winding body 43U forms part of a winding device 45U and is, for example, spring-loaded by means of a spring arrangement 44U in the sense of winding up the tension member 130 or driven by a drive motor not shown in the drawing. The respective length of the traction member 130 unwound or adjusted by the traction member drive 41U can be detected by means of a rotational speed sensor 46U.

The positioning drives comprise, for example, communication interfaces 47, 47U, in particular network interfaces (LAN, WLAN or the like), for communication with the control device 32 via the communication links 38. The communication interfaces 47 can also be or comprise Bluetooth interfaces, for example. An interface 39 of the control device 32 is designed for communication with the communication interface 47, therefore it includes, for example, a LAN, WLAN, Bluetooth interface or the like.

The positioning drives 40, 40U are held or arranged, for example, on a carrier 48 or a housing 48 which is fastened in place on the holding base 21 of a respective holding device 20.

A positioning drive 140 can also be used instead of a positioning drive 40, 40U. The positioning drive 140 comprises a drive motor 141 which is used to drive a drive roller 142. The drive roller 142 is arranged between an angle body 143, a winding device 145 and a guide body 28. A respective length of the section of the traction member 30 operated by the drive motor 141 can be detected, for example, by a rotational speed sensor 146, an encoder, which is arranged between the drive roller 142 and the guide device 27.

It is advantageous if a section of the traction member 30 is tensioned between the drive roller 142 and the winding device 145, for example using a tensioning device 149. The tensioning device 149 comprises a tensioning element 148, for example a tensioning roller, over which the traction member 30 runs. Thus, the section of the traction member 30 running between the drive roller 142 and the winding body 143 of the winding device 145 is kept under tension. As a result, among other things, the winding onto the winding member, onto the winding body 143, is optimized.

The winding body 143 can also be driven by a spring arrangement. In the present case, a winding drive 144, for example an electric motor, is provided. Based on the course of the traction member 30 between the tensioning member 147 and the winding body 143, the winding drive 144 can be activated, in particular regulated, for example to keep the traction member 30 under tension in this region.

A guide device is preferably provided for guiding the traction member 30 onto the winding body 143. This is illustrated in the drawing using the example of a winding body 243 and a guide device 248.

In a positioning drive 240, its winding device 245 simultaneously forms the positioning drive or the traction drive for the traction member 30. The traction member 30 runs from a drive roller 242 past a rotational speed sensor 246 to the guide body 248A of the traction member guide device, guide device 248. The speed sensor 246 measures the length of the traction member 30 unwound or wound onto the winding device 245 and thus the travel of the working device 50 when the traction member 30 is operated by the positioning drive 240.

The winding device 245 has a winding drive 244, which at the same time represents the traction member drive 241. The traction member drive 241 or winding drive 244 comprises, for example, an electric motor which can be controlled by the control device 32 via a communication interface 247.

The guide device 248 comprises, for example, a slide or traction member guide body 248A which is guided on a guide 248B. The guide 248B is, for example, a linear guide that runs parallel to an axis of rotation D2 about which the winding body 243 rotates. The traction member guide body 248A thus performs an oscillating back and forth movement along the linear guide 248B, such that the traction member 30 is optimally wound onto and unwound from the roller 243A.

It is possible that the control device 32 also controls the guide device 248 for the traction member 30. It is further possible that the winding device 245 has a local controller for the guide device 248 or that this guide device 248 functions automatically, so to speak, that is to say that it automatically follows the movement of the traction member 30 and ensures that a winding 243A of the traction member 30 wound onto the winding body 243 is accurately wound.

It is also possible to position the working device 50 by means of a positioning drive located on board the working device 50 relative to the workpiece surface or room surface FL, FR, FF, FD to be processed. For example, positioning drives 340A, 340B can be provided on the working device 50, which drives have drive motors, for example working device drives 341A, 341B. The working device drives 341A, 341B drive, for example, wheels or drive rollers 342 which can roll along the surface FL, FR, FF, FD to be processed. The working device drives 341A, 341B are assigned to different directions of movement or axes of movement, for example at angles to one another, in particular at right angles. Thus, for example, the control device 32 can also control the positioning drives 340A, 340B for positioning the working device 50 relative to the surface FL, FR, FF, FD to be processed.

The working device 50 comprises a machine tool 51. The machine tool 51 can also be considered a working device 50. The working device 50 or machine tool 51 comprises a drive unit 52 with a drive motor 53. A stator 54 of the drive motor 53 is arranged in a stationary manner with respect to a carrier 60 of the drive unit 52. A rotor 55 of the drive motor 53 rotates about a motor axis of rotation DM.

The drive motor 53 drives a tool holder 58 on which a work tool 90A, for example a plate tool 90, can be or is arranged.

An output 56 of the rotor 55, on which, for example, a gearwheel is arranged, drives an eccentric 57, in particular a drive 57B, e.g. a gearwheel, of the eccentric 57. The eccentric 57 has the tool holder 58 for the plate tool 90. The tool holder 58 is arranged on a rotary bearing 59 of the eccentric 57, such that the tool holder 58 can rotate about a tool axis of rotation DW. The tool axis of rotation DW and the motor axis of rotation MD have an eccentricity EX to one another. Thus, the plate tool 90 carries eccentrically about the motor axis of rotation DM and in a hypercycloid movement about the tool axis of rotation DW. Smooth running of the plate tool 90 can thus be achieved, which facilitates manual operation of the working device 50, but also operation using the positioning drives 40.

The carrier 60 has a cover wall 61 which covers the plate tool 90 at least on the upper side, preferably also on its outer circumference 93.

A motor mount 62, in which the drive motor 53 is received, projects in front of the cover wall 61. On its side facing away from the plate tool 90, the drive motor 53 has a fan 63 with which a flow of cooling air can be generated, which air passes through the drive motor 53.

The cooling air flow KL can flow out via a suction port 71 of a suction device 70 of the working device 50. The suction hose 11, for example, is connected to the suction port 71.

The plate tool 90 has a processing surface 91 for processing one of the surfaces FL, FR, FF, FD of the room RA, it being understood that another surface, for example a wood workpiece or a metal workpiece, can also be processed with the processing surface 91. Abrasive means, polishing means or the like can be arranged directly on the processing surface 91. In the present case, an adhesive layer 98 is provided on which a grinding means 99 is detachably held, for example an abrasive sheet. The adhesive layer includes, for example, Velcro fasteners, Velcro hooks, etc.

In the present case, the processing surface 91 is a planar surface, but it can also have a depression or a similar other contour, for example.

The plate tool 90 has a machine side 92, wherein the machine side 92 and the processing surface 91 face away from one another or are arranged on opposite sides of the plate tool 90.

The machine side 92 is provided on a plate tool carrier 100 and faces the cover wall 61 of the carrier 60. An elastic layer 101, for example, a so-called grinding pad or carrier pad, is arranged on the plate tool carrier 100, which is essentially rigid, for example made of a respectively resilient plastic material. The processing surface 91 is arranged on the side of the layer 101 facing away from the plate tool carrier 100.

Intake air inflow openings 94 are provided on the processing surface 91 and are flow-connected with the intake air outflow openings 95 on the machine side 92. For example, flow channels pass through the layer 100 and the plate tool carrier 101. Intake air AL can flow into the intake air inflow openings 94 through the intake air inflow openings 94. The intake air AL is shown in the drawing by hatched arrows.

The intake air AL serves to suction the plate tool 90 and thus also the working device 50 onto the workpiece surface to be processed.

The intake air inflow openings 94 are provided in a ring shape on the processing surface 91. For example, multiple, particularly at least two, in the present case four, concentric ring arrangements 94 A, 94B, 94C, 94D of intake air inflow openings 94 are provided.

The intake air inflow openings 94 are arranged in a ring about the central axis of the plate tool 90, which in the present case corresponds to the tool axis of rotation DW.

The intake air outflow openings 95 are likewise arranged in a ring about the tool axis of rotation DW. It is possible that multiple, particularly concentric, ring arrangements of intake air outflow openings 95 are provided. The drawing regularly shows a single ring arrangement of intake air outflow openings 95.

Additional air inflow openings 96, through which additional air ZL can flow into the plate tool 90, are also provided on the plate tool 90. The additional air ZL is shown symbolically in the drawing by white arrows. The additional air inflow openings 96 are flow-connected to the additional air outflow openings 97 on the machine side 92 of the plate tool 90, for example by means of unspecified flow channels which penetrate the adhesive layer 98, the elastic layer 101, and the plate tool carrier 100.

In principle, it is possible that the additional air ZL also ensures that the plate tool 90 is suctioned onto the surface FL, FR, FF, FD to be processed. Additional air inflow openings 196 are provided on a plate tool 190 for this purpose, for example.

In the case of the plate tool 90, however, the additional air inflow openings 96 are arranged on its outer circumference 93. The additional air inflow openings 96 are thus oriented radially outward relative to the central axis, in the present case the tool axis of rotation DW, of the plate tool 90. Thus, the additional air ZL can convey particles, dust or the like from the surroundings of the plate tool 90 in the direction of the plate tool 90 and flow out through the additional air outflow openings 97.

The suction device 70 has an intake air inlet 72 which is assigned to the intake air outflow openings 95 and is flow-connected to them. Furthermore, the suction device 70 comprises an additional air inlet 73 which is flow-connected to the additional air outflow openings 97.

The intake air inlet 72 is defined by a seal 74, for example an annular seal, which rests against the machine side 92 of the plate tool 90. The seal 74, like a seal 75, is designed as an annular seal, the seal 75 being located radially outward with respect to the seal 74. An annular chamber, which defines the additional air inlet 73, is thus defined between the seals 74, 75. The radially outer seal 75 seals the auxiliary air inlet 73 from atmospheric pressure.

The intake air inlet 72 is, so to speak, a central intake chamber which is located in the interior of the seal 74. The intake air inlet 72 communicates directly with the suction port 71 and thus with the vacuum generator 15 via a bypass channel 76.

The additional air inlet 73 communicates with the suction port 71 via a valve 85, the valve member 86 of which is adjustable between at least two, preferably multiple, valve positions.

The valve 85 forms part of a suction controller 80 or can be controlled by the same. The valve member 86 is adjustable within a valve housing 87 of the valve 85, for example pivotable about a pivot axis SW1. Using the valve member 86, a valve passage 88 on the valve housing 87 can be opened or closed, wherein intermediate positions are also possible. On the inlet side, the valve 85 communicates with the additional air inflow openings 96, namely with the additional air inlet 73. The valve passage 88 and thus the outlet of the valve 85 is flow-connected to the suction port 71. Thus, depending on the valve position of the valve member 86, more or less intake air is suctioned in from the additional air outflow openings 97 and transported away via the suction port 71.

The valve member 86 has a cylinder jacket-like peripheral wall 86A, which can be moved past the inner circumference of a likewise cylindrical peripheral wall 87A of the valve housing 87. The peripheral walls 86A, 87A abut in a substantially sealing manner. A seal 88A is arranged between one end face of the peripheral wall 86A and the cover wall 61 of the carrier 60, which in this respect forms part of the valve housing 87. The seal 88A simultaneously acts as a clamping device 88B for clamping the valve member 86 in a respective valve position.

The peripheral wall 86A protrudes from a cover wall or bottom wall 86B of the valve member 86. The peripheral wall 87A of the valve housing 87 extends between the cover wall 86B and the cover wall 61 of the carrier. Thus the valve member 87 is sandwiched between the cover walls 61, 86B.

A pivot bearing 86C is provided for mounting the valve member 86 with respect to the valve housing 87. A bearing projection 86D, for example, protrudes from the cover wall 61 and engages in a bearing receptacle 86E of the valve member 86. A fastening element 86G, for example a screw, is used to secure the valve member 86 to the bearing projection 86D. The fastening element 86G preferably creates a bias of the valve member 86 in the direction of the seal 88A. The fastening element 86G extends, for example, parallel to the pivot axis SW1.

On the side facing away from the interior of the valve 85, the valve member 86 has an operating handle 86F which is used for gripping by an operator.

The operating handle is designed at the same time as an index element which can be adjusted, for example, in the direction of markings 89A-89D which indicate the respective valve position of valve 85.

One or more of the markings 89A-89D can, for example, have latching projections 89E with which the valve member 86, in particular the operating handle 86F, can be latched, for example with a latching lug or a latching projection 89F at its free end region. For example, the latching projections 89E can be provided in pairs at at least one of the markings 89A-89D, such that the operating handle 86F can latch between the latching projections 89E.

The markings 89A, 89D correspond, for example, to a passage position and a blocking position of the valve 85. The markings 89B, 89C indicate a mixing ratio of intake air flowing through the additional air inflow openings 96 and intake air flowing through the intake air inflow openings 94, which is optimally suitable for example for a side wall processing (marking 89B) or for a ceiling processing (marking 89C). When working on the ceiling, for example the ceiling surface FD, as little additional air as possible is suctioned in, such that the suction power or suction force in the normal direction N, which can be generated by the intake air via the intake air inflow openings 94, is as large as possible.

A working device 50A and its plate tool 90 essentially correspond to the working device 50, wherein a valve 185 is provided instead of the valve 85. The valve 185 either forms a component of a suction controller 180 or can be actuated by said controller. The valve 185 is used to control the negative pressure in the region of the additional air outflow openings 97, but pivots about a pivot axis SW2 which is transverse to the direction of flow of the intake air flow that flows through the suction port 71. A valve member 186 of the valve 185 is preferably arranged below the suction port 71. The valve member 186 has, for example, a partially cylindrical peripheral wall 186A, which extends between end walls 186B, 186C. The end walls 186B, 186C are, so to speak, the bottom and top sides of the imaginary cylinder of the valve member 186. Bearing projections 186D which engage in corresponding receptacles in the valve housing 187 and enable the valve member 186 to be pivoted about the pivot axis SW2 are for example arranged on the end walls 186A, 186B.

An operating handle 186F protrudes in front of the end wall 186B, for example an operating lever or operating projection, on which the operator can adjust the valve member 186 such that a valve passage 188 provided on the peripheral wall 186, i.e. an interruption of the peripheral wall 186 across a predetermined angular segment, can be brought into a passage position at the outlet of the additional air inlet 73, that is, that an opening between the seals 74, 75, is open, for example. However, when the peripheral wall 186A closes this opening 189.

In a working device 50B shown schematically, a valve 285 is provided instead of the valve 85 or 185. The valve 285 has a valve member 286 which can be manually operated using an operating handle 286*f*. The operating handle 286F is arranged on the valve member 286 of the valve 285. The valve member 286 has a plate-shaped wall body 286A. The wall body 286 has a partially annular shape, such that it can close or open a likewise partially annular opening on the cover wall 61, which opening defines a valve passage 288 of the valve 285.

The valve passage 288 extends within a valve housing 287 of the valve 285. The valve housing 287 has side walls 287A which protrude from the cover wall 61 and are closed by a cover wall 287B. The suction port 71 is arranged on the cover wall 287B.

Furthermore, the valve housing 287 communicates with the intake air outflow openings 95, which are arranged in the interior of a peripheral wall 287C of the valve housing 287. In the interior space delimited by the peripheral wall 287C, which, so to speak, defines the intake air inlet 72, the drive motor 53 (shown schematically) is arranged, for example.

The operating handle 286F can, for example, engage in a guide recess 289, which is, for example, a kind of extension of the valve passage 288, having a clamping section or latching section not visible in the drawing, in order to latch, jam or the like the valve member 286 in one or multiple valve positions relative to the valve housing 287, in this case to the cover wall 61. The clamping section or latching section can, for example, engage in the guide recess 289 and be in engagement behind the same.

The guide recess 289 and the valve passage 288 run in a ring around a pivot axis SW3 about which the valve member 286 can pivot. The valve member 286 is adjusted about the pivot axis SW3 in a type of sliding movement along the valve passage 288. The pivot axis SW3 and the motor axis of rotation DM are preferably coaxial.

A valve 385 of a working device 50C essentially corresponds to the valve 285. Similar components are therefore identified by reference numerals which are by 100 greater than that of the valve 286. If the same components are present, these are provided with the same reference numerals.

A valve member 386 of the valve 385 closes a valve passage 388 which, like the valve passage 388, extends in an arc or ring shape around the pivot axis SW3. However, an operating handle 386F for manually operating the valve member 386 is not guided on the valve passage 388, but on a guide 385G that is separate therefrom.

The guide 386G, like the valve passages 288, 388, extends in a ring about the pivot axis SW3. Using the separate guide 386G, any desired clamping devices, latching devices or the like for clamping or latching the operating handle 386B and thus the valve member 386 in predetermined valve positions can be implemented.

The valve 385 preferably comprises a valve drive 82, for example a drive motor 382, which is in driving engagement with, for example, the cover wall 61 or another component that is stationary with respect to the carrier 60. For example, the drive motor 382 can have a pinion on its output, which pinion engages in a gearing fixed on the carrier 60. For a manual operation of the valve 385 the pinion can, for example, be disengaged from the gearing or the drive motor 382 can run with little resistance. Decoupling of a valve drive for manual operation of a valve is therefore possible within the scope of the invention.

A working device 50D is constructed similarly to the working device 50B, 50C and has a valve 485 instead of the valves 285, 385. The valve 485 has a valve housing 487 which is constructed similarly to the valve housing 287 and accordingly has the same reference numerals in the drawing. A valve passage 488 of the valve 485 communicates with the additional air inlet 73 and can be closed by a valve member 486.

The valve member 486 has a wall-like or plate-like shape, for example a plate body 486A, which can be pivoted about a pivot axis SW4 between a passage position DS, in which the valve passage 488 is flow-connected to the suction port, and a closed position SS, in which the valve passage 488 is closed.

The negative pressure present at the suction port 71 applies a force on the valve member 486 in the direction of its open position DS and can be acted upon by an operating device with an operating element 486B in its closed position SS.

Instead of or in addition to the operating element 468B, a spring 468K can easily be provided which forces the valve member 486 into its closed position SS. In this case, the valve 485 works in a pressure-controlled manner, that is, when the negative pressure at the suction port 71 is greater than the spring force of the spring 468K, the valve 485 opens, such that the negative pressure in the suction region or on the processing surface 91 of the plate tool 90 drops because, so to speak, external air can flow through the additional air inflow openings 96.

The operating element 486B is pivotably mounted to the valve housing 487, for example to one of the side walls 487. The operating element 486B comprises, for example, a pivot lever, the free end region of which can act on the valve member 486 in order to move it into the closed position SS. The operating element 486 thus has, for example, a lever-like shape or a lever.

An operating handle 486F, for example a pivot lever, which is arranged on an outer side of the valve housing 487, for example, also on one of the side walls 487A or 487B, is connected to the operating element 486B. The operating handle 486B includes, for example, an operating lever that can be gripped by the operator. The operating handle 486F can be latched in various latching positions which correspond to the valve positions of the valve 485, for example the positions DS or SS, using a latching device 486H, for example in the passage position and/or the blocking position and preferably one or more intermediate valve positions. The latching device 486H has, for example, latching projections 4861 with which the operating lever 486G can be latched. The latching projections 4861 project from one of the side walls 487A.

A so-to-speak automatic valve 585 of the working device 50E, which operates in any case depending on the position, has a valve member 586 in the form of a roller, in particular a ball or the like. The valve member 586 is received in a valve housing 587 of the valve 585 in such a manner that it can move freely. The valve housing 587 has, for example, a peripheral wall or side walls 587A, which taper, so to speak, towards an outlet 587B of the valve housing 587 or are oriented towards one another. The valve housing 587 is therefore narrower in the region of the outlet 587B than in the region of one or more valve passages 588 which are provided on a wall 588A which, so to speak, closes the additional air inlet 73. Consequently, air flowing via the additional air inlet 73 can flow via one or more of the valve passages 588 to the outlet 587B, which in turn is flow-connected to the suction port 71.

When the working device 50 assumes an overhead position, for example when processing the ceiling surface FD, the valve member 386 moves away from the valve passage 588 into a position that closes the outlet 587B, which is indicated in the drawing with a continuous line of the valve member 586. Thus, air flowing through the additional air inflow openings 96, which represents false air, so to speak, can no longer reach the suction port 71, as a result of which the suction force in the region of the intake air inflow openings 94 is increased. If, however, the working device 50 assumes a vertical orientation, for example, that is to say that the working surface 91 runs vertically, the valve member 586 can move away from the outlet 587B, for example slide or roll along a slope of the side walls 587A, such that the outlet 587B becomes free and thus supply air or false air can enter via the additional air inflow openings 96.

The drawing also indicates that the valve member 586 can also move into a position that closes the at least one valve passage 588 (shown in dashed lines).

In the embodiment of the plate tool 190, it is also indicated that an additional air inflow opening 196 can also be arranged on the processing surface 91, such that the valve 585 can be directly used, for example, to influence the air flow flowing over the processing surface 91 or the negative pressure prevailing there.

In addition to the, so to speak, automatically functioning concepts of influencing the negative pressure by manually operated valves or position-dependent valves (585), servomotor or regulated concepts are also easily possible:

For example, the suction controller 80 comprises a regulating device 81. The regulating device 81 can, for example, control the motorized valve drive 82, in particular a servomotor. The valve drive 82 can for example directly drive one of the valve members 86, 186, 286, 386, or 486.

The valve drive 82 can also include, for example, a magnetic drive 582, for example an electrical coil, in order to operate the valve member 586 for moving into one or more valve positions.

The suction controller 80 can use sensor signals from one or more sensors of a sensor arrangement 83 to control the valve drive 82, for example using a position sensor 83A, the output signal of which indicates an angular position of the working device 50 relative to an underlying surface, for example the surface FD. A motor sensor 83B in turn is, for example, a current sensor or comprises a current sensor, the output signal or sensor signal of which, for example, indicates an output of the drive motor 53. Depending on the suction of the working device 50 onto the surface to be processed, the friction of the processing surface 91 on the surface to be processed changes, wherein the drive power of the drive motor 53 and thus its motor current then also changes, which can be detected by the motor sensor 83B. The control device 81 can then, for example, actuate the motorized valve drive 82 in the case of an increased motor output in the sense of a reduction in negative pressure in the intake region, and in the case of a decreasing motor output in the sense of an increase in the negative pressure.

But direct pressure measurement or flow measurement is also possible, namely using the pressure sensor 83C and/or the flow sensor 83D. For example, the pressure sensor 83C is arranged in the negative pressure region or suction region and directly measures the negative pressure with which the plate tool 90 and thus the working device 50 is suctioned onto the surface to be processed.

For example, a force sensor 83F, 83G can be used, for example a strain gauge or the like, which measures the pressing force with which the contact body 65B and/or the plate tool 90 presses against the surface to be processed. The force sensor 83G can be provided, for example, on the drive train, for example on a bearing, of the working device 50. If the contact force of the contact body 65B becomes too great, the suction controller 80, in particular the regulating device 81, can actuate the valve drive 82 in the sense of reducing the negative pressure, or if the pressing force is too low, in the sense of increasing the pressing force.

The working devices 50, 50A, 50B, 50C, 50D, 50E, 50F can be provided for manual operation, that is to say, operation guided by an operator. However, it is also possible that they are used in connection with the positioning device 13 for a type of robot operation.

For example, the working device 50 is described below in an installation position in a housing 64 which can be operated by the positioning device 13. The carriers 60 of the other working device 50A, 50B, 50C, 50D, 50E, 50F can also be operable by the traction members 30 and can preferably also be accommodated in the housing 64.

It can be seen that the working device 50 can be used autonomously or hand-held.

The traction members 30, for example, can also act directly on it. In the present case, however, the working device 50 is designed in such a manner that the carrier 60 including all components held thereon, namely the drive unit 52 and plate tool 90/work tool 90A are accommodated in a housing 64. The housing 64 forms a suction housing 64A, the interior space 64E of which forms a vacuum space, so to speak.

The housing 64 has a peripheral wall 64B which is covered by a cover wall 64C. The cover wall 64C has a dome or a hood 64D, in which a flow channel or a flow chamber for the cooling air KL is formed, which air flows out of the drive motor 53 or its fan 63. The cooling air KL can be sucked off via a suction port 64F, to which, for example, the suction hose 1 can be connected directly. The suction port 64F communicates fluidically with the suction port 71 of the drive unit 52, which is arranged in the interior space 64E, such that air flowing out of the suction port 71, which represents an exhaust air nozzle, can be suctioned out via the suction port 64F.

Traction member holders 67 are provided on the housing 64, to which holders the traction members 30A-30D can be detachably fastened, for example, can be connected by means of a latch arrangement, can be connected to a magnetic holder or the like. Thus, the traction members 30 can be easily detached from the holders 67 by an operator or easily attached to the latter, but then have a firm hold, such that the tensile forces of the positioning device 13 or the positioning drives 40 can be transmitted to the working device 50.

The holders 67 are provided at the same angular intervals, for example of 90° each, on the housing 64, such that the tensile forces of the traction elements 30 can be optimally transmitted to the housing 64.

The housing 64 also carries a guide device 65 which is used to guide the surface FL, FR, FF or FD to be processed. The guide device 65 comprises a guide support 65A which is fastened to the housing 64 or forms an integral part of the housing 64. The guide carrier 65A supports at least one contact body 65B, for example, an annular contact body 65B or an arrangement of a plurality of contact bodies arranged in a ring shape, which extend around the work tool 90A. The guide supports 65A have guide contours 65C, for example guide surfaces, which preferably are in the same plane as the processing surface 91 when the machine tool 51 is in contact with one of the surfaces FL-FD, as is shown schematically in the drawing. The contact body 65B preferably comprises a seal, in particular a sealing ring, which defines a suction region 65G of the housing 64. The plate tool 90 or work tool 90A is arranged within the suction region 65G.

It can be seen that thus not only the plate tool 90, but also the entire housing 64 is suctioned onto the surface of the workpiece or the room to be processed. However, the working device 50 is guided primarily via the contact body 65B with respect to the surface to be processed.

The contact body 65B is movably supported with respect to the guide carrier 65A and is spring-loaded by springs 65D in the direction of a contact position in which the guide contours 65C contact the surface to be processed. Like the contact body 65B, the springs 65D are accommodated in a spring chamber 65E, where they are linearly movable in the normal direction with respect to the processing surface 91 or in the normal direction with respect to the guide contour or guide surface 65C, preferably also pivotable transversely to this direction. This is because the contact body 65B is preferably not only mounted to the guide support 65A in a linearly displaceable manner parallel to the motor axis of rotation DM or the tool axis of rotation DW, but also transversely thereto about at least one pivot axis. The contact body 65B is therefore floatingly mounted in the spring chamber or bearing receptacle 65E.

The plate tool 90 is preferably flexible with respect to the surface to be processed, for example due to the elastic layer 101. An optimal adaptation to the contour of the surface to be processed is further improved by the fact that the drive unit 52 is movably supported with respect to the guide device 65 by means of a bearing device 66.

The bearing device 66 comprises, for example, a membrane 66A which is fastened in place relative to the housing 64, namely for example sandwiched between holding sections 66B, 66C, which are provided on the one hand by the housing 64, namely its peripheral wall 64B, and on the other hand by a valve carrier 64H. The valve carrier 64H extends in an annular manner around the work tool 90A and is, so to speak, sandwiched between the guide device 65, in particular the guide carrier 65A, and the peripheral wall 64B.

The membrane 66A thus enables a floating, multi-axial pivoting movement of the drive unit 52 with respect to the housing 64 or the guide device 65, such that the work tool 90A can easily follow a surface contour of the surface to be processed. In addition, the work tool 90A can be adjusted linearly with respect to the guide device 65, namely parallel to the tool axis of rotation DW.

Instead of the membrane 66A, for example, pivot bearings, in particular gimbal pivot bearings, and/or sliding bearings may be provided.

The drive unit 52 and thus the work tool 90A are preferably spring-loaded into a contact position in which they are in contact with the workpiece surface to be processed, for which a spring arrangement 69 is provided, for example. The spring arrangement 69 comprises an arrangement of one or more springs 69A, which are supported on the one hand on the housing 64 or the carrier 60 and on the other hand on the membrane 66A, namely by means of spring holders 69B, 69C. The spring holders 69C are arranged on the membrane 66A, the spring holders 69B are stationary with respect to the guide device 65, namely stationary with respect to the housing 64. Since the housing 64 is stationary with respect to the guide device 65, the spring holders 69B support the springs 69A, the bearing device 66 and thus the drive unit 52 held thereon with respect to the guide device 65.

The bearing device 66 further allows that the work tool 90A moves from the working position shown in the drawing, in which the work tool 90A is in contact with the surface to be processed, into a rest position shifted away therefrom. For this purpose, actuators 68, for example servo-motors or the like, are provided. The actuators 68 have drive elements 68A, for example levers, rollers or the like, with which they act on transmission elements 68B, for example traction members, tension cables, rod-like members or the like. The transmission elements 68B are connected to the drive members 68A and the drive unit 52, namely to the membrane 66A, which in turn are connected to the drive unit 52. The transmission elements 68B therefore pull the membrane 66A away from the guide contour 65C, so to speak, in order to move the work tool 90A into the rest position. The rest position is advantageous, for example, when the work tool 90A is not needed, in particular when it is prepositioned before the actual surface treatment. As a result, the plate tool 90 cannot cause any damage, so to speak, but is instead made inactive or held in the rest position until the actual surface treatment begins.

The actuator(s) 68 preferably act on the membrane 66A or the drive assembly 52 at at least two opposing or several points having the same angular distances from one another.

It is possible that a basic suction force with which the plate tool 90 suctions onto a surface to be processed is set on the basis of the valves 85-585. However, it is also possible for the valves 85-585 to be fully opened. In both scenarios, the suction force controller or influence by negative pressure as explained below can be used advantageously:

This is because additional air which flows through the additional air inflow openings 96 can not only be influenced on the machine side 92 of the plate tool 90, but also from outside, so to speak.

This is because valves 685 are arranged on the housing 64, in particular the valve carrier 64H, of the working device 50. The valves 685 have valve passages 688 which are arranged, for example, on a wall 687 of the valve support 64B. The wall 687 extends in an annular manner next to the peripheral wall 64B of the suction housing 64A and forms a kind of step. Preferably, a plurality of mutually spaced apart, in particular angularly spaced apart, valve passages 688 are provided on the wall 687. The valve passages 688 have, for example, an annular shape and thus follow the outer peripheral contour of the peripheral wall 64B. The valve passages 688 are in fluid communication with an annulus 689 that extends around the work tool 90A. The annular space 689 is also open to the additional air inflow openings 96 on the radial outer periphery of the work tool 90A, such that air flowing in via the valve openings 688 can reach the additional air inflow openings 96 and thus reduce the suction force in the region of the intake air inflow openings 94, so to speak. False air, so to speak, is then suctioned in via the suction port 71 or 64F, namely through the valve openings 688 and the additional air inflow openings 96.

The valves 685 comprise valve members 686. The valve members 686 are plate-like and have a support layer 686A on which a sealing layer 686B is arranged. The sealing layer 686B faces the wall 687 and is suitable for sealingly closing the respective valve passage 688.

The valve member 686 is movably mounted on bearing projections 686C, 686D which project in front of the wall 687. For example, the bearing projections 686C, 686D are bolts, screws or the like, along which the valve member 686 can slide and/or pivot.

In a closed position SS, the valve member 686 closes the valve passage 688, while it is released in an open position DS of the valve member 686.

Linear adjustment of the valve member 686 relative to the longitudinal axes of the bearing projections 686C, 686D is possible, for example. In the present case, however, a pivoting movement of the valve member 686 at one of the bearing projections 686C, 686D is desired. The pivoting movement is triggered or made possible, for example, in that springs 686F, 686G, which are arranged on the bearing projections 686C, 686D and are supported on support projections 686H of the same, and the valve member 686 differ in thickness or are biased to different degrees. For example, the spring 686F has a smaller spring force than the spring 686G because it is less biased.

The springs 686F, 686G press the valve member 686 into the closed position SS. The valve member 686 can be moved into its open position DS by the negative pressure in the suction region 64G. Because if the atmospheric pressure is greater than the negative pressure in the suction region 64G to a predetermined extent, it acts on the valve member 686 in the sense of opening the valve 685. In this way, automatic, so-to-speak, negative pressure regulation is implemented by a spring arrangement.

In addition, the operator can also let external air or additional air flow into the suction region 64B via valves 685M. The valves 685M include valve passages 688B that are disposed on the radially outer circumference of the valve carrier 64H. The valve passages 688 are flow-connected to the suction region 64G and can be closed by at least one valve member 686M. The valve member 686M is for example an annular body, in particular with a plate shape, which can be pivoted about an axis of rotation parallel to the axis of rotation of the motor MD. A plurality of operating handles 686H, for example operating projections, are arranged on the valve member 686M, such that the operator can adjust the valve member 686M between a passage position that opens the valve passages 688B and a closed position that closes them, and preferably one or more valve positions in between, by moving one of the operating handles 686H.

The working devices 50, 50A, 50B, 50C, 50D, 50E, 50F can be adjusted by the positioning device 13 relative to the surfaces to be processed. However, it is also possible to operate it using a handle, which will become even clearer below.

A rod-shaped handle 800 is preferably articulated to the working device 50, 50A, 50B, 50C, 50D, 50E, 50F in a multi-axial pivotable manner. For example, a swivel joint 801 is provided, which supports the handle 800 so as to be able to pivot with respect to a pivot axis SQ which runs transversely to a longitudinal axis LL of the handle 800. Further pivotability about another pivot axis, which for example runs transversely to the pivot axis SQ, is implemented by a pivot joint 801, which is only indicated schematically in the drawing. The pivot joints 801, 802 together form a gimbal pivot joint.

A fixed rod section 803 of the handle 800 runs from the pivot joint 801 along the longitudinal axis LL. At the longitudinal end region of the rod section 803 distant from the working device 50, a powering device 804 is provided for power supply, for example, to the drive motor 53. At this point, it should also be mentioned that the drive motor 53 is preferably an electronically or electrically commutated drive motor.

The powering device 804 is arranged between the rod section 803 and a telescoping section 805 of the handle 800. The telescoping section 805 comprises a base tubular body 806 which is fixedly connected to the powering device 803. An adjustable tubular body 807 is mounted on the base tubular body 806 so as to be movable with respect to the longitudinal axis LL. For example, the adjustable tubular body 807 engages in an interior space of the base tubular body 806.

A support body 808, which preferably extends transversely to the longitudinal axis LL, is located at the free end region of the adjustable tubular body. The support body 808 is suitable, for example, as a support for resting against a body of the operator, for example as a type of shoulder support or the like. This makes the handle 800 extremely ergonomic.

The adjustable tubular body 807 can be adjusted relative to the base tubular body 806 along an adjustment path which is limited by longitudinal stops 809, 810, which are arranged on the base tubular body 806 or on the adjustable tubular body 807.

In a respective longitudinal position of the adjustable tubular body 807 relative to the base tubular body 806, the latter can be fixed by means of a fixing device 811. The fixing device 811 comprises, for example, a holder which is fastened to the base tubular body 806 in the manner of a sleeve or clamp, for example using radially protruding retaining projections 815 which are for example screwed together, braced or the like. The holder 812 has a clamp 813 which, by means of an operating handle 814, for example a clamping screw, a clamping lever or the like, is adjustable between a position that clamps or fixes the adjustable tubular body 807 with respect to the base tubular body 806 and a position releasing it with respect to the base tubular body 806 and thus adjustable release position.

The working device 50F should be considered an example of the fact that a coating device or a working device suitable for machining a workpiece surface, for example an area, can also be operated and positioned using the positioning device 13.

The working device 50F has a coating device 980 having coating heads 981A, 981B as coating tools 981. The coating heads 981A, 981B are designed for coating a surface to be processed or coated, i.e. they can apply a coating fluid, in particular a color liquid, color particles, to the surface, for example. The coating fluid is contained in reservoirs 983A, 983B of the working device 50F and/or is supplied to the working device 50F via flexible lines from a stationary device, for example a storage container on a vacuum cleaner 15B. For example, paint or a similar other coating fluid can be contained in the reservoirs 983A, 983B, which fluid can flow via lines 982A, 982B to the coating heads 981A, 981B in order to coat the surface to be processed, for example to color it and/or to be provide it with a protective layer or the like.

Furthermore, the coating device 980 can also include, for example, an erasing device 985, in particular an erasing head, with which at least parts of the coating applied using the coating heads 981A, 981B can be erased again.

The erasing device 985 or the erasing head as well as the coating tools 981 or coating heads 981A, 981B are or can be connected, for example, via communication lines 984 to the control device 32. Instead of a communication line 984, a wireless connection, for example a radio connection, from and to the control device 32 can of course also be provided. Via the communication lines 984, the control device 932 can, for example, control the application of paint or similar other coatings by the coating tools 981 or coating heads 981A, 981B, or it can cause or actuate an erasure by the erasing device 985, which includes, for example, an eraser, a grinding head or the like.

The coating device 980 is arranged on a, particularly plate-like, support body 990. The support body 990 has, for example, a base body 998 on which a processing surface 991 is provided, for example a support surface for resting against the surface to be processed. The processing surface 991 is provided, for example, on a sliding body or a sliding layer 999 which is arranged on the front side of the base body 998.

The coating heads 981A, 981B and the erasing head 985 are arranged, for example, on cavities of the base body 998 that are set back behind the processing surface 991.

The additional air inflow openings 96 already explained above, the intake air inflow openings 94 and the like, for example, which communicate with the additional air inlet 73 already explained above and the intake inlet 72, can be arranged on the base body 998. Suction control is possible, for example, by means of the valve 585, such that the processing surfaces 991, like the processing surfaces 91 already explained above, can be optimally suctioned onto the surface to be processed.

All of the aforementioned exemplary embodiments in connection with the working devices 50-50E are therefore also possible in the working device 50F with regard to suction control or vacuum control on the working surface 991, which is or forms a support surface in this respect.

Furthermore, the working device 50F can comprise or form a machine tool 951. This can be provided as an alternative or in addition to the coating device 980.

The machine tool 951 comprises a drive motor 953 which drives a tool holder 958 via a tool shaft 956. A work tool 90F, for example a milling head, is or can be arranged on the tool holder 958.

The processing surface 991 forms, for example, a guide contour 965C of a guide device 965.

The milling head or other work tool 90F can project permanently in front of the processing surface 991 or guide contour 965C or, advantageously, can be movable by means of an actuator 994 between a position (shown in dashed lines) that projects further in front of the processing surface 991 or guide contour 965C and a working position or depth setting position less far away from the processing surface 951 or guide contour 965C, in particular even retracted behind the working surface 991. Thus, the work tool 90F can penetrate more or less far into the workpiece to be processed. It is particularly possible during positioning by the positioning device 13, in which the work tool 90F is not processing the surface to be processed or is inactive, that the work tool 90F is moved back behind the guide contour 965C, such that it is not in contact with the workpiece.

The actuator 954 and the drive motor 953 are or can be connected via communication links 955, for example communication lines or wireless connections, to the control device 32 which controls the drive motor 953 and the actuator 954 as required for the workpiece surface to be processed.

In the same way, it is basically also possible that, for example, the coating tool 981 and/or the erasing device 985 can be moved into a position that projects further in front of the guide contour 965C or into a farther retracted position, in particular behind the same, by arranging the actuators 986 on the coating tools 981 and/or the erasing device 985. The actuators 986 can be controllable by the control device 32 in a wireless or wired manner not shown herein.

Further exemplary embodiments are outlined in connection with FIG. 12. For example, cutting tools can also be attached to the housing 64 and/or a coating device relative to the guide device 65, in particular to the guide contour 65C, such that they are kept floating and/or movable, for example by means of the bearing device 66.

For example, instead of the plate work tool 90, a milling head or similar other cutting work tool can be driven by the drive motor 53. For example, instead of the connection to the eccentric 57, a tool holder 58F can be provided directly on the drive motor 53, to which the work tool 90F, for example a milling head, drill or the like, can be fastened directly. To adjust the work tool 90F relative to the carrier 60, the actuator 954 already explained above and shown schematically in the drawing can be provided.

As an alternative or in addition, at least one coating tool 981 can also be arranged on the carrier 60. The coating tool 981, for example one of the coating heads 981A and/or 981B, can be arranged in a stationary manner on the carrier 60 or, by means of an actuator 986, can be movable between a position that projects further in front of the guide contour 65C or a position that is further set back with respect to the guide contour 65C, in particular one that is set back behind the guide contour 65C.

The invention claimed is:

1. A mobile machine tool for processing a surface of a workpiece or a room, wherein the machine tool comprises a working device with a plate tool for processing the surface and a drive motor for driving the plate tool, which has a processing surface assigned to processing a workpiece and a machine side opposite to the processing surface, wherein intake air inflow openings are arranged on the processing surface for suctioning the processing surface onto the surface to be processed, which openings are flow-connected to at least one intake air outflow opening arranged on the plate tool away from the processing surface, wherein the plate tool comprises at least one additional air inflow opening for the inflow of additional air, which is flow-connected to at least one additional air outflow opening arranged away from the processing surface, and wherein the machine tool comprises an intake device for generating an intake air flow from the at least one intake air outflow opening and an additional intake air flow from the at least one additional air outflow opening, and wherein the intake device comprises a suction controller for controlling the additional intake air flow from the at least one additional air outflow opening, and wherein the intake air flow from the at least one intake air outflow opening is influenced by controlling the additional intake air flow from the at least one additional air outflow opening, and wherein the suction controller comprises at least one valve for controlling the intake air flow from the at least one intake air outflow opening, wherein a valve inlet of the valve is connected with the at least one additional air outflow opening, and a valve outlet of the valve is connected to a vacuum generator, and the at least one valve comprises a valve member which is adjustable between at least two valve positions in which a flow cross section of the valve is different, and wherein the valve comprises a motorized valve drive for automatically adjusting the valve member depending on an angular position of the working device in relation to an underlying surface, and wherein the mobile machine tool further comprises a rod-shaped handle for gripping by an operator, the rod-shaped handle being pivotably mounted to the working device about at least two pivot axes which are at an angle to one another.

2. The machine tool according to claim 1 wherein the intake device has a vacuum generator arranged on the working device for generating a vacuum or an intake air flow or comprises a suction port for a vacuum generator separate from the machine tool.

3. The machine tool according to claim 1, wherein the valve member is rotatably or movably or pivotably mounted between the at least two valve positions with respect to a valve housing of the valve.

4. The machine tool according to claim 1, further comprising a fixing device, or has at least one magnet for fastening the valve member in place in at least one valve position.

5. The machine tool according to claim 1, wherein the valve member is spring-loaded in the direction of a closed position closing the valve and can be moved by negative pressure in the direction of an open position.

6. The machine tool according to claim 1, further comprising at least one bypass channel which is flow-connected to the at least one air outflow opening and bypasses the at least one valve.

7. The machine tool according to claim 1, wherein the at least one additional air inflow opening comprises or is formed by an additional air inflow opening arranged on the processing surface or on an outer circumference of the plate tool between the machine side and the processing surface.

8. The machine tool according to claim 1, wherein the plate tool comprises an arrangement of inflow openings running in a ring about an axis of rotation or about a central axis of the plate tool orthogonal to the processing surface, wherein the at least one additional air inlet opening or the intake air inflow openings form a part of the arrangement of inflow openings.

9. The machine tool according to claim 8, wherein the inflow openings of the respective arrangement of inflow openings are arranged at equal angular distances from one another or wherein the arrangement of additional air inflow openings and the arrangement of intake air inflow openings are concentric in relation to the axis of rotation or central axis of the plate tool.

10. The machine tool according to claim 1, wherein the at least one intake air outflow opening or the at least one additional air outflow opening are arranged on the machine side of the plate tool.

11. The machine tool according to claim 1, wherein the plate tool comprises an arrangement of outflow openings running in a ring about an axis of rotation or about a central axis of the plate tool orthogonal to the processing surface, wherein the at least one intake air outflow opening or the at least one additional air outflow opening forms a part of the arrangement of outflow openings.

12. The machine tool according to claim 11, wherein the outflow openings of the respective arrangement of outflow openings are arranged at equal angular distances from one another or wherein the arrangement of additional air outflow openings and the arrangement of intake air outflow openings are concentric in relation to the axis of rotation or the central axis of the plate tool.

13. The machine tool according to claim 1, wherein the intake device comprises an intake air inlet associated with the at least one intake air outflow opening and an additional air inlet associated with the at least one additional air outflow opening.

14. The machine tool according to claim 13, wherein the intake air inlet or the additional air inlet have an annular or partially annular geometry or wherein the intake air inlet and the additional air inlet run in an annular manner about an axis of rotation of the plate tool or a central axis of the plate tool or are concentric in relation to the axis of rotation or central axis.

15. The machine tool according to claim 13, wherein the intake air inlet and the additional air inlet are flow-separated from one another by at least one seal.

16. The machine tool according to claim 15, wherein the at least one seal comprises, relative to an axis of rotation or central axis of the plate tool, a radially outer seal and a radially inner seal which are provided or designed to rest on the machine side of the plate tool and which define an annular chamber running about the axis of rotation or central axis of the plate tool and a central chamber enclosed by the annular chamber and fluidically separated from the annular chamber by the radially inner seal, wherein the annular chamber forms the additional air inlet and the central chamber forms the intake air inlet or the annular chamber forms the intake air inlet and the central chamber forms the additional air inlet, or said chambers are associated with the respective inlet.

17. A mobile machine tool for processing a surface of a workpiece or a room, wherein the machine tool comprises a working device with a plate tool for processing the surface and a drive motor for driving the plate tool, which has a processing surface assigned to processing a workpiece and a machine side opposite to the processing surface, wherein intake air inflow openings are arranged on the processing surface for suctioning the processing surface onto the surface to be processed, which openings are flow-connected to at least one intake air outflow opening arranged on the plate tool away from the processing surface, wherein the plate tool comprises at least one additional air inflow opening for the inflow of additional air, which is flow-connected to at least one additional air outflow opening arranged away from the processing surface, and wherein the machine tool comprises an intake device for generating an intake air flow from the at least one intake air outflow opening and an additional intake air flow from the at least one additional air outflow opening, and wherein the intake device comprises a suction controller for controlling the additional intake air flow from the at least one additional air outflow opening, and wherein the intake device comprises an intake air inlet associated with the at least one intake air outflow opening and an additional air inlet associated with the at least one additional air outflow opening, and wherein the intake air inlet and the additional air inlet are flow-separated from one another by at least one seal running in a ring around an axis of rotation or a central axis of the plate tool, and wherein the at least one seal comprises, relative to an axis of rotation or central axis of the plate tool, a radially outer annular seal and a radially inner annular seal, the radially outer annular seal and the radially inner annular seal comprising a rubber or other elastic material to sealingly seat on the machine side of the plate tool, the radially outer annular seal and the radially inner annular seal defining an annular chamber running about the axis of rotation or central axis of the plate tool and a central chamber enclosed by the annular chamber and fluidically separated from the annular chamber by the radially inner annular seal, wherein the annular chamber forms the additional air inlet and the central chamber forms the intake air inlet or the annular chamber forms the intake air inlet and the central chamber forms the additional air inlet, or said chambers are associated with the respective inlet, and wherein the mobile machine tool further comprises a rod-shaped handle for gripping by an operator, the rod-shaped handle being pivotably mounted to the working device about at least two pivot axes which are at an angle to one another.

* * * * *